US009267733B2

(12) United States Patent
Karikusa et al.

(10) Patent No.: US 9,267,733 B2
(45) Date of Patent: Feb. 23, 2016

(54) SHEET CONVEYOR, COOLING DEVICE, AND IMAGE FORMING APPARATUS

(71) Applicants: Yuji Karikusa, Ibaraki (JP); Kenji Ishii, Ibaraki (JP)

(72) Inventors: Yuji Karikusa, Ibaraki (JP); Kenji Ishii, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/487,435

(22) Filed: Sep. 16, 2014

(65) Prior Publication Data

US 2015/0075207 A1 Mar. 19, 2015

(30) Foreign Application Priority Data

Sep. 17, 2013 (JP) ..... 2013-191999

(51) Int. Cl.

| | |
|---|---|
| ***G03G 15/00*** | (2006.01) |
| ***G03G 21/16*** | (2006.01) |
| ***F25D 25/04*** | (2006.01) |
| ***B65H 29/12*** | (2006.01) |
| ***B65H 5/02*** | (2006.01) |

(52) U.S. Cl.

CPC ..... *F25D 25/04* (2013.01); *B65H 5/023* (2013.01); *B65H 29/12* (2013.01); *G03G 15/6573* (2013.01); *G03G 21/1647* (2013.01); *G03G 21/1695* (2013.01); *B65H 2301/5144* (2013.01); *B65H 2402/441* (2013.01); *B65H 2403/42* (2013.01); *B65H 2404/2614* (2013.01); *B65H 2601/321* (2013.01); *B65H 2801/27* (2013.01); *G03G 2215/0129* (2013.01)

(58) Field of Classification Search

CPC ..... B65H 3/04; B65H 3/0669; B65H 3/0638; F25D 25/04; G03G 2215/00805; G03G 15/2035

See application file for complete search history.

(56) References Cited

U.S. PATENT DOCUMENTS

| | | | | |
|---|---|---|---|---|
| 5,099,288 | A * | 3/1992 | Britto et al. | 399/320 |
| 5,893,019 | A * | 4/1999 | Yoda et al. | 399/321 |
| 5,970,301 | A * | 10/1999 | De Cock | 430/124.3 |
| 2003/0108371 | A1 * | 6/2003 | Regimbal | 399/329 |

(Continued)

FOREIGN PATENT DOCUMENTS

JP 2010-002644 1/2010

OTHER PUBLICATIONS

Translation of JP2010002644.*

(Continued)

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

A sheet conveyor includes a first conveyance belt, a second conveyance belt, a first driving roller, a second driving roller, a first gear, and a second gear. In switching between sandwich and separation states, an axial center of a rotation shaft of the first or second gear moves on a movement plane substantially perpendicular to a direction in which the first conveyance belt and the second conveyance belt convey a sheet. Where L represents diameter of a tooth edge circle of the second gear in unit of millimeter and T1 represents a chordal tooth thickness of the second gear, an acute-side angle θ in unit of degree (°) formed by the movement plane and an interaxial-center plane including the axial center of the rotation shaft of each of the first gear and the second gear in the sandwich state is within a range represented by the following Formula 1: $\mathrm{Tan}^{-1}(2\times T1/L)<|\theta|<45°$.

18 Claims, 14 Drawing Sheets

(56) References Cited

U.S. PATENT DOCUMENTS

| | | | | |
|---|---|---|---|---|
| 2005/0031364 | A1* | 2/2005 | Hayashi | 399/69 |
| 2005/0214669 | A1* | 9/2005 | Hayashi et al. | 430/109.4 |
| 2010/0052244 | A1* | 3/2010 | Terao | 271/109 |
| 2010/0178078 | A1* | 7/2010 | Tamura et al. | 399/123 |
| 2012/0141176 | A1* | 6/2012 | Matsushima et al. | 399/341 |
| 2013/0177332 | A1* | 7/2013 | Saito | 399/92 |
| 2014/0042689 | A1* | 2/2014 | Ota et al. | 271/10.11 |
| 2014/0186080 | A1 | 7/2014 | Ikeda et al. | |
| 2014/0186081 | A1 | 7/2014 | Hirasawa et al. | |
| 2014/0233996 | A1 | 8/2014 | Ikeda et al. | |
| 2014/0294476 | A1* | 10/2014 | Hashimoto et al. | 399/361 |
| 2014/0308058 | A1* | 10/2014 | Ikeda et al. | 399/341 |
| 2015/0115525 | A1* | 4/2015 | Deno | 271/227 |

OTHER PUBLICATIONS

NPL regarding gearing terms.*
U.S. Appl. No. 14/276,067, filed May 13, 2014.
U.S. Appl. No. 14/248,652, filed Apr. 9, 2014.
U.S. Appl. No. 14/321,908, filed Jul. 2, 2014.

* cited by examiner

ENGAGED

RELEASED
(SEPARATED)

SHEET CONVEYOR, COOLING DEVICE, AND IMAGE FORMING APPARATUS

CROSS-REFERENCE TO RELATED APPLICATIONS

This patent application is based on and claims priority pursuant to 35 U.S.C. §119(a) to Japanese Patent Application No. 2013-191999, filed on Sep. 17, 2013, in the Japan Patent Office, the entire disclosure of which is incorporated by reference herein.

BACKGROUND

1. Technical Field

Embodiments of this disclosure relate to a sheet conveyor to sandwich and convey a sheet, such as a sheet of paper or a sheet-type recording medium, with a conveyance belt, a belt-type cooling device employing the sheet conveyor, and an image forming apparatus including at least one of the sheet conveyor and the cooling device.

2. Description of the Related Art

Image forming apparatuses are used as printers, facsimile machines, image forming apparatus, plotters, or multi-functional devices having, e.g., two or more of the foregoing capabilities. As one type of image forming apparatus that forms an image on a sheet of paper or a sheet-type recording medium, an image forming apparatus is known that includes a sheet conveyance assemble to sandwich and conveys the sheet of paper or the sheet-type recording medium with a pair of endlessly-movable conveyance belts. For example, an image forming apparatus includes the following sheet conveyor.

The sheet conveyor includes a first conveyance belt and a second conveyance belt to sandwich and convey a sheet. The sheet conveyor also includes two gears to engage each other in a sandwich state in which the sheet is sandwiched with the first conveyance belt and the second conveyance belt and disengage from each other in a separation state in which the sheet is not sandwiched with the first conveyance belt and the second conveyance belt. For example, the sheet conveyor includes a first gear (drive transmission gear) coupled to a first driving roller for endlessly moving the first conveyance belt and a second gear (drive transmission gear) to rotate a second driving roller for endlessly moving the second conveyance belt. During maintenance, such as sheet jam processing (clearance) or replacement of conveyance belts, the sheet conveyor can perform switching operation between a sandwich state in which the first conveyance belt and the second conveyance belt are disposed opposing and in proximity to each other to sandwich a sheet and a separation state in which the first conveyance belt and the second conveyance belt are separated from each other to allow an operator to remove a jammed sheet or a conveyance belt. In conjunction with the switching operation between the sandwich state and the separation state, the sheet conveyor engages the first gear and the second gear with each other in the sandwich state and moves the first gear to a position at which engagement of the first gear and the second gear is released in the separation state.

BRIEF SUMMARY

In at least one embodiment of this disclosure, there is provided an improved a sheet conveyor including a first conveyance belt and a second conveyance belt to sandwich and convey a sheet, a first driving roller to rotate the first conveyance belt, a second driving roller to rotate the second conveyance belt, a first gear to transmit a rotation driving force to the first driving roller, and a second gear to engage the first gear and transmit, to the first gear, a rotation driving force of a driving source for rotating the second driving roller. The first gear and the second gear engage each other in a sandwich state in which the first conveyance belt and the second conveyance belt are to sandwich and convey the sheet, and disengage from each other in a separation state in which the first conveyance belt and the second conveyance belt are separated from each other. In switching between the sandwich state and the separation state, an axial center of a rotation shaft of the first gear or the second gear moves on a movement plane substantially perpendicular to a direction in which the first conveyance belt and the second conveyance belt convey the sheet. Where L represents diameter of a tooth edge circle of the second gear in unit of millimeter and T1 represents a chordal tooth thickness of the second gear, an acute-side angle θ in unit of degree (°) formed by the movement plane and an interaxial-center plane including the axial center of the rotation shaft of the first gear and the axial center of the rotation shaft of the second gear in the sandwich state is within a range represented by the following Formula 1: $\mathrm{Tan}^{-1}(2\times T1/L)<|\theta|<45°$.

In at least one embodiment of this disclosure, there is provided an improved cooling device including the above-described sheet conveyor and a cooling member. The sheet conveyor sandwiches and conveys the sheet with the first conveyance belt and the second conveyance belt. The cooling member contacts an inner circumferential surface of at least one of the first conveyance belt and the second conveyance belt and absorbs heat of the sheet.

In at least one embodiment of this disclosure, there is provided an improved image forming apparatus including the above-described cooling device to cool the sheet having a raised temperature.

In at least one embodiment of this disclosure, there is provided an improved image forming apparatus including the above-described sheet conveyor to sandwich and convey the sheet with paired conveyance belts including the first conveyance belt and the second conveyance belt.

In at least one embodiment of this disclosure, there is provided an improved a sheet conveyor including a first conveyance belt and a second conveyance belt to sandwich and convey a sheet, a first driving roller to rotate the first conveyance belt, a second driving roller to rotate the second conveyance belt, a first gear to transmit a rotation driving force to the first driving roller, a second gear to engage the first gear and transmit, to the first gear, a rotation driving force of a driving source for rotating the second driving roller, and a movement assembly to move the first conveyance belt to engage the first gear and the second gear with each other in a sandwich state in which the first conveyance belt and the second conveyance belt are to sandwich and convey the sheet, and disengage the first gear and the second gear from each other in a separation state in which the first conveyance belt and the second conveyance belt are separated from each other. In switching between the sandwich state and the separation state, an axial center of a rotation shaft of the first gear or the second gear moves on a movement plane crossing a direction in which the first conveyance belt and the second conveyance belt convey the sheet. The movement assembly is disposed at a first end side in a rotation axis direction of the second driving roller and includes a rotation unit to hold the first conveyance belt relative to the second conveyance belt so as to be rotatable around a rotation shaft. The first gear and the second gear are disposed at one end of the first driving roller and the second driving roller, respectively, to engage each other at a second end side of the first conveyance belt and the second conveyance belt opposite the first end side at which the rotation unit is disposed.

In at least one embodiment of this disclosure, there is provided an improved cooling device including the above-described sheet conveyor and a cooling member. The sheet conveyor sandwiches and conveys the sheet with the first conveyance belt and the second conveyance belt. The cooling member contacts an inner circumferential surface of at least one of the first conveyance belt and the second conveyance belt and absorbs heat of the sheet.

In at least one embodiment of this disclosure, there is provided an improved image forming apparatus including the above-described cooling device to cool the sheet having a raised temperature.

In at least one embodiment of this disclosure, there is provided an improved image forming apparatus including the above-described sheet conveyor to sandwich and convey the sheet with paired conveyance belts including the first conveyance belt and the second conveyance belt.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
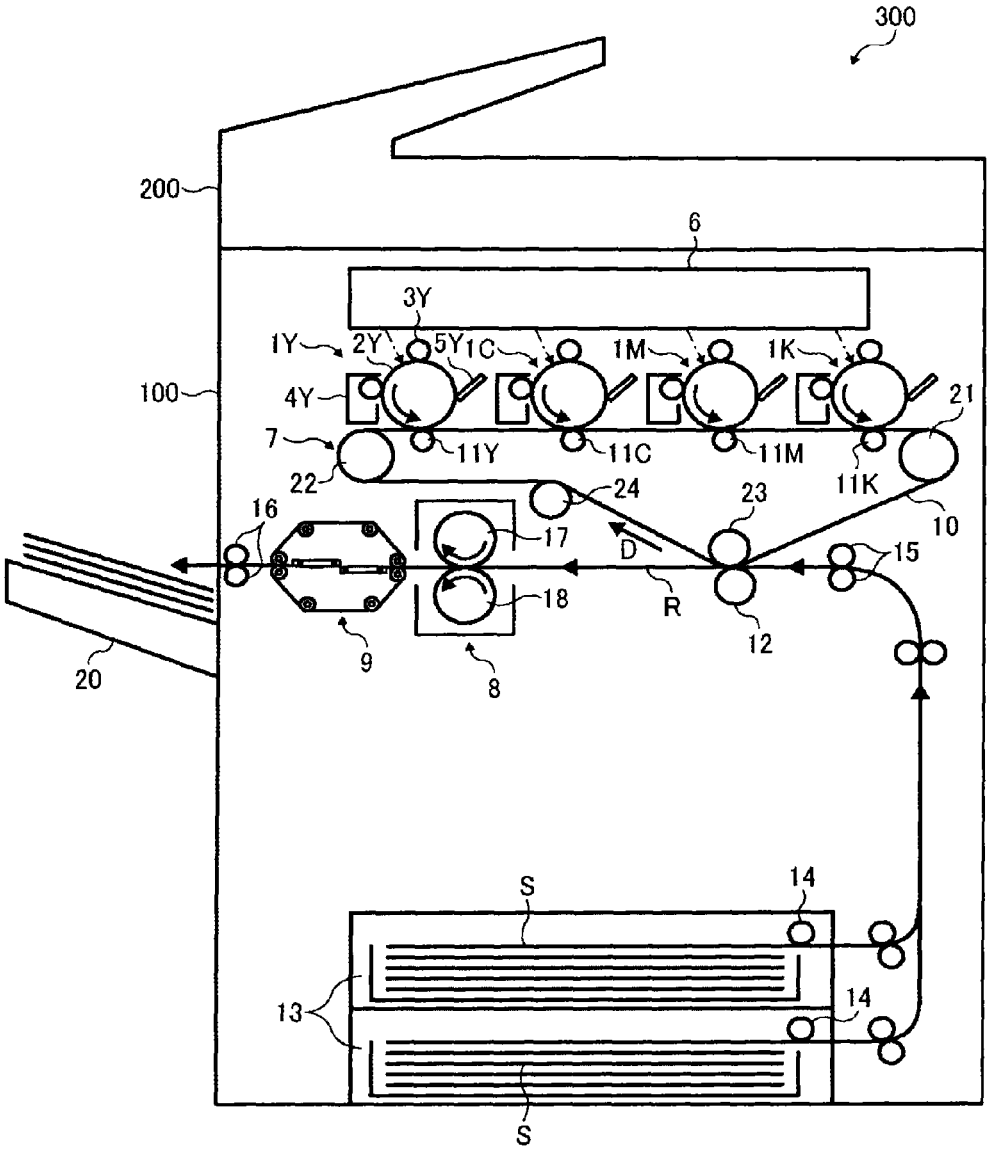
FIG. 1 is a schematic view of an image forming apparatus illustrated as a multifunction peripheral according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Below, an image forming apparatus including a cooling device according to an embodiment of this disclosure is described with reference to drawings.

Figure 2:
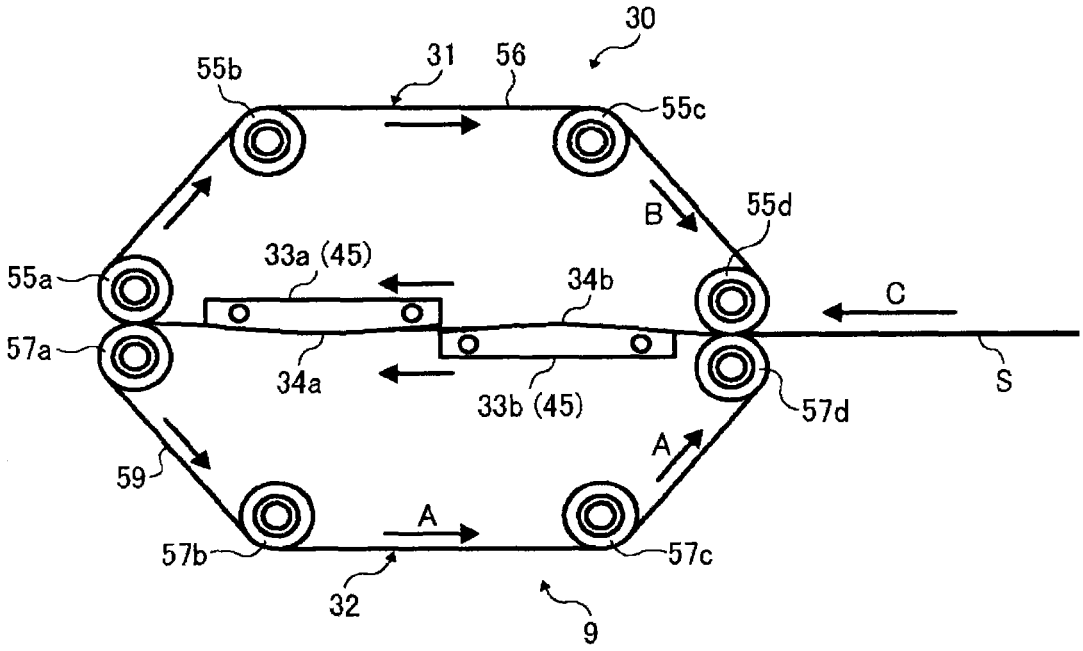
FIG. 2 is a schematic view of a cooling device according to an embodiment of this disclosure, seen from a front-face side thereof.
Figure 3:
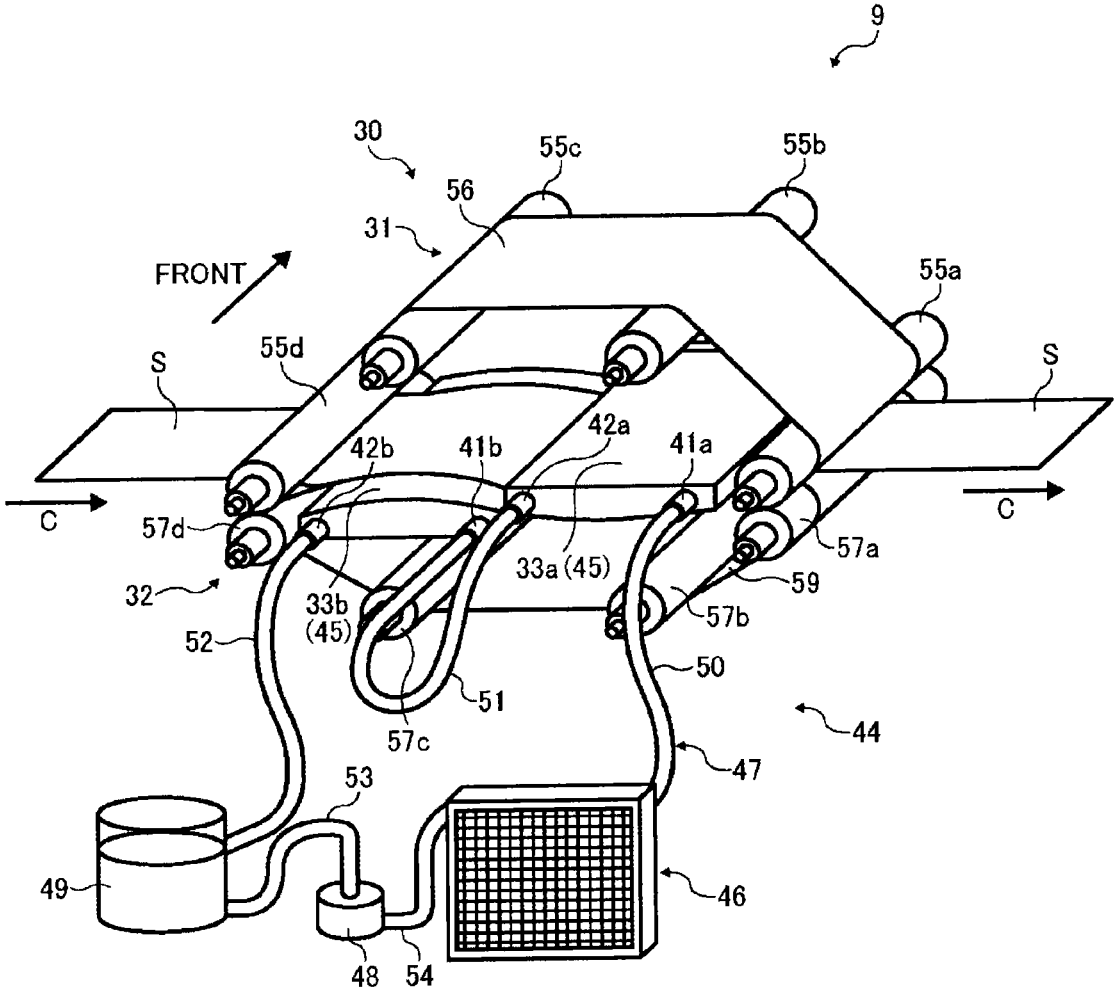
FIG. 3 is a perspective view of the cooling device illustrated in FIG. 2, seen from a rear-face side thereof.
Figure 4:
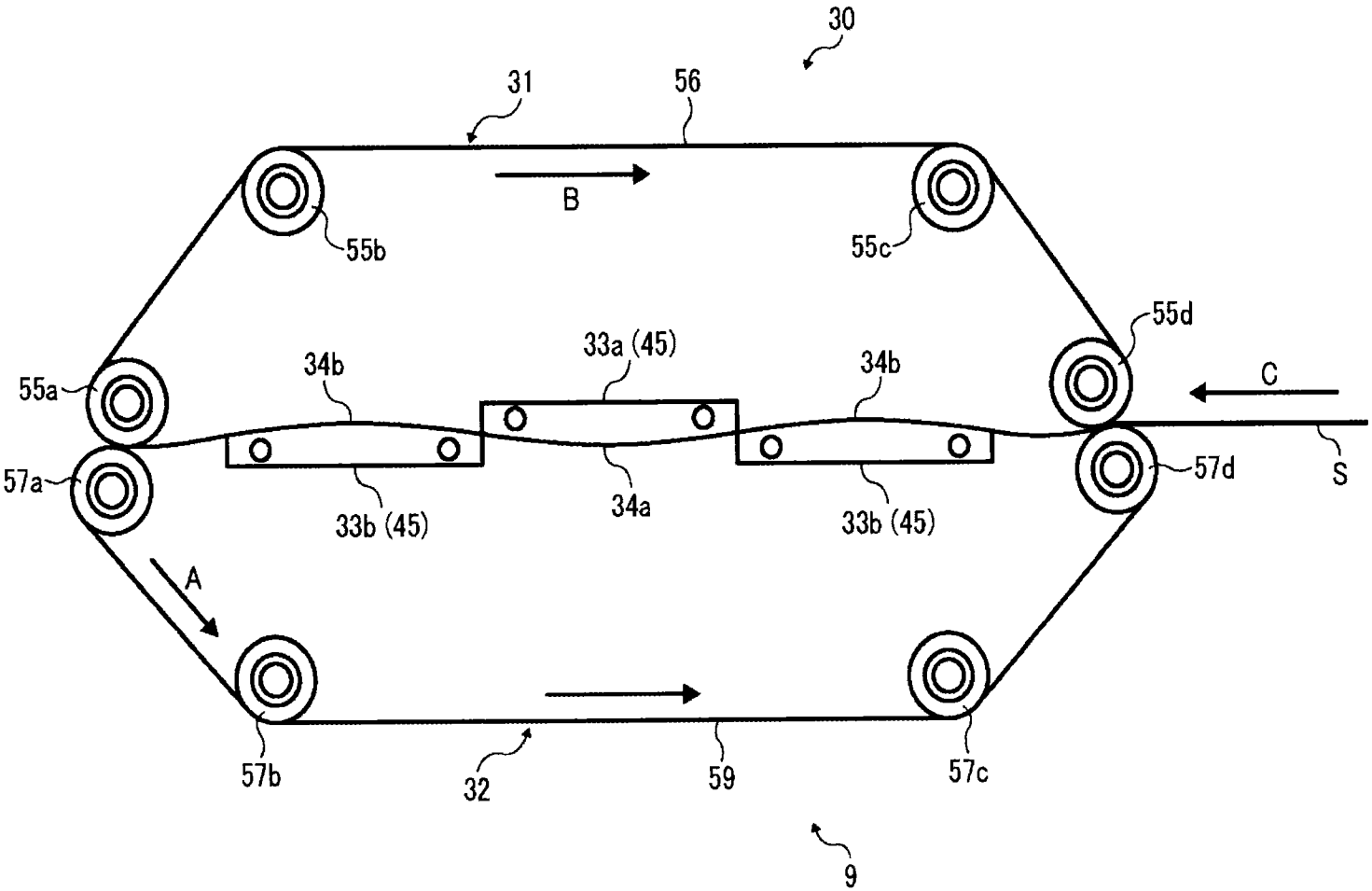
FIG. 4 is a schematic view of a cooling device according to an embodiment of this disclosure, seen from a front-face side thereof.
Figure 5:
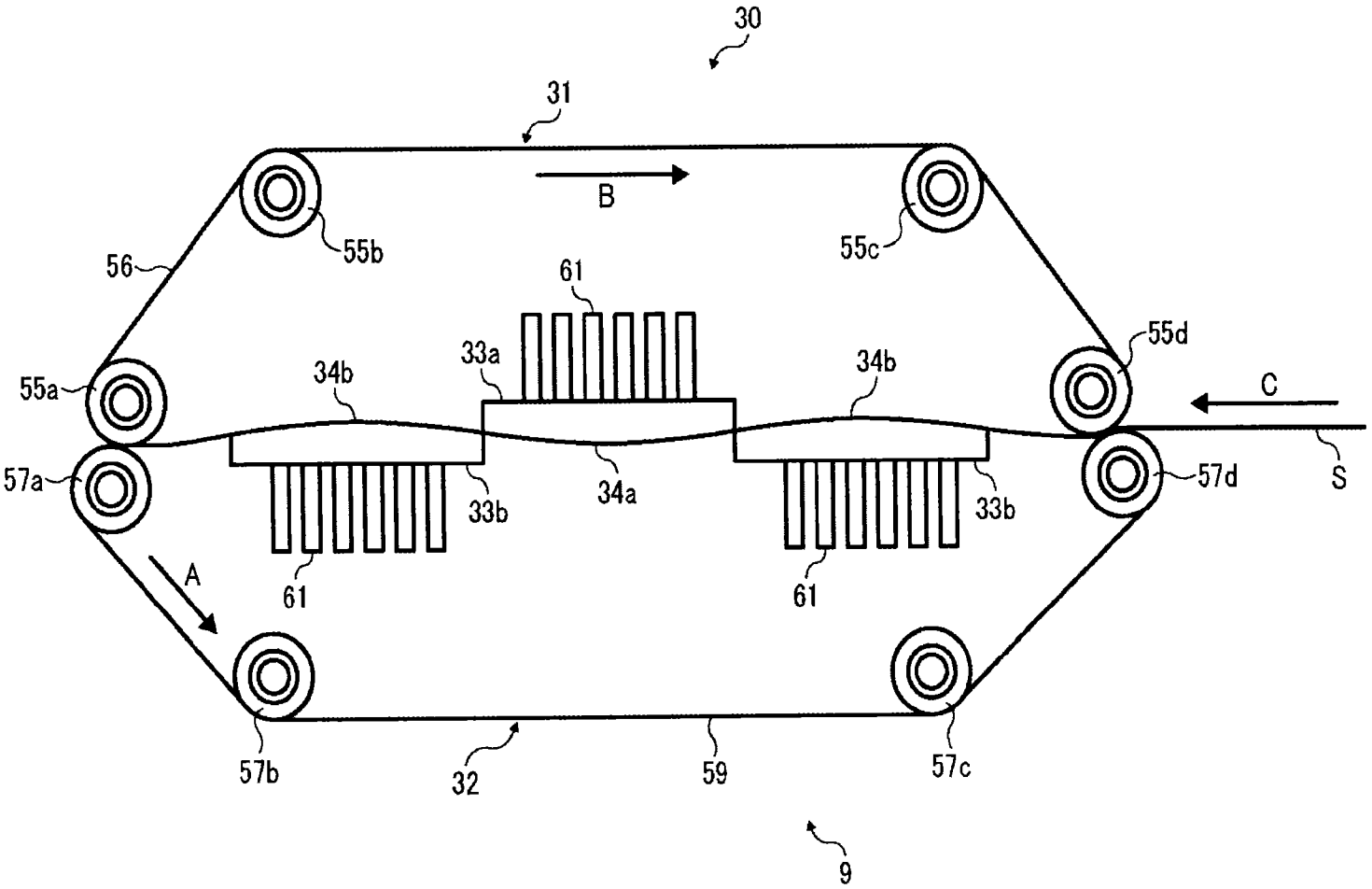
FIG. 5 is a schematic view of a cooling device according to an embodiment of this disclosure, seen from a front-face side thereof.

FIG. 1 is a schematic view of an image forming apparatus 300 according to this embodiment of this disclosure. FIG. 2 is a schematic view of a cooling device 9 according to an embodiment of this disclosure, seen from a front-face side thereof. FIG. 3 is a perspective view of the cooling device 9 illustrated in FIG. 2, seen from a rear-face side thereof. FIG. 4 is a schematic view of a cooling device 9 according to an embodiment of this disclosure, seen from a front-face side thereof. FIG. 5 is a schematic view of a cooling device 9 according to an embodiment of this disclosure, seen from a front-face side thereof.

In FIG. 1, the image forming apparatus 300 is illustrated as a multi-functional device having several of capabilities of printer, copier, plotter, facsimile machine, and so forth. However, it is to be noted that an image forming apparatus according to an embodiment of this disclosure is not limited to the multi-functional device and may be any other suitable type of image forming apparatus.

In the image forming apparatus 300 according to this embodiment, as illustrated in FIG. 1, a scanner 200 is provided in an upper area of an apparatus body 100 to read a document. According to image data received from an external device, such as a personal computer, or image data of a document read by the scanner 200, the image forming apparatus 300 forms an image on a sheet S, such as a sheet of paper or a sheet-type recording medium, in an electrophotographic method. Here, since the scanner 200 may have a known configuration, descriptions of the configuration of the scanner 200 are omitted. In the following, configuration and operation of the apparatus body 100 having a printer capability are described below.

As illustrated in FIG. 1, the apparatus body 100 of the image forming apparatus 300 includes a tandem-type image forming unit in which four process units 1Y, 1C, 1M, and 1Bk serving as image forming units are arranged side by side above a stretched surface of an intermediate transfer belt 10 serving as an intermediate transfer body of a transfer device 7.

The process units 1Y, 1C, 1M, and 1Bk are removably mountable relative to the apparatus body 100 of the image forming apparatus 300 and have substantially the same configuration except for containing different color toners of yellow (Y), cyan (C), magenta (M), and black (Bk) corresponding to color separation components of a color image.

Specifically, each of the process units 1Y, 1C, 1M, and 1Bk includes, e.g., a photoreceptor 2, a charging roller 3, a developing device 4, and a cleaning blade 5. The photoreceptor 2 has, e.g., a drum shape and serves as a latent image carrier. The charging roller 3 serves as a charging device to charge a surface of the photoreceptor 2. The developing device 4 forms a toner image on the surface of the photoreceptor 2. The cleaning blade 5 serves as a cleaner to clean the surface of the photoreceptor 2. In FIG. 1, the photoreceptor 2, the charging roller 3, the developing device 4, and the cleaning blade 5 of the process unit 1Y for yellow are represented by the photoreceptor 2Y, the charging roller 3Y, the developing device 4Y, and the cleaning blade 5Y, respectively. Regarding the other process units 1C, 1M, and 1Bk, color index are omitted for simplicity.

As illustrated in FIG. 1, above the process units 1Y, 1C, 1M, and 1Bk, an exposure device 6 is disposed to expose the surface of the photoreceptor 2. The exposure device 6 includes, e.g., a light source, polygon mirrors, f-lenses, and reflection lenses to irradiate a laser beam onto the surface of the photoreceptor 2.

The transfer device 7 is disposed below the process units 1Y, 1C, 1M, and 1Bk. The transfer device 7 includes the intermediate transfer belt 10 which is an endless belt serving as an intermediate transfer body as described above. An inner circumferential surface of the intermediate transfer belt 10 is stretched over a first stretching roller 21, a second stretching roller 22, and a third stretching roller 23 serving as support members. A tension roller 24 presses an outer circumferential surface of the intermediate transfer belt 10 toward an inner circumferential side of the intermediate transfer belt 10 to apply tension to the intermediate transfer belt 10. When one of the first stretching roller 21, the second stretching roller 22, and the third stretching roller 23 rotates as a driving roller, the intermediate transfer belt 10 is endlessly moved (traveled to circulate) clockwise (in a direction indicated by arrow D in FIG. 1).

Four primary transfer rollers 11 serving as primary transfer devices are disposed at positions at which the primary transfer rollers 11 oppose the respective photoreceptors 2 via the intermediate transfer belt 10. At the respective positions, the primary transfer rollers 11 presses against the inner circumferential surface of the intermediate transfer belt 10. Thus, primary transfer nips are formed at positions at which the photoreceptors 2 contact pressed portions of the intermediate transfer belt 10. Each of the primary transfer rollers 11 is connected to a power source, and a predetermined direct current (DC) voltage and/or an alternating current (AC) voltage are supplied to the primary transfer rollers 11.

A secondary transfer roller 12 serving as a second transfer device is disposed at a position at which the secondary transfer roller 12 opposes the third stretching roller 23 to stretch the intermediate transfer belt 10. The secondary transfer roller 12 presses against the outer circumferential surface of the intermediate transfer belt 10. Thus, a secondary transfer nip is formed at a position at which the secondary transfer roller 12 and the intermediate transfer belt 10 contact each other. Similarly with the primary transfer rollers 11, the secondary transfer rollers 12 is connected to a power source, and a predetermined direct current (DC) voltage and/or an alternating current (AC) voltage are supplied to the secondary transfer roller 12.

Below the apparatus body 100 is a plurality of feed trays 13 to store sheets S which are sheet-type recording media, such as sheets of paper or overhead projector (OHP) sheets. Each feed tray 13 is provided with a feed roller 14 to feed the sheets S stored. A discharge tray 20 is mounted on an outer lateral surface of the apparatus body 100 at the left side in FIG. 1 to stack sheets S discharged to an outside of the apparatus body 100.

The apparatus body 100 includes a transport passage R to transport a sheet S from the feed trays 13 to the discharge tray 20 through the secondary transfer nip. On the transport passage R, registration rollers 15 are disposed upstream from the secondary transfer roller 12 in a conveyance direction of a recording material (hereinafter, sheet conveyance direction). A fixing device 8, the cooling device 9, and paired discharge rollers 16 are disposed in turn at positions downstream from the secondary transfer roller 12 in the sheet conveyance direction. The fixing device 8 includes a fixing roller 17 and a pressing roller 18. The fixing roller 17 serves as a fixing member including an internal heater. The pressing roller 18 serves as a pressing member to press the fixing roller 17. A fixing nip is formed at a position at which the fixing roller 17 and the pressing roller 18 contact each other.

Next, a basic operation of the image forming apparatus 300 for copying a document is described with reference to FIG. 1.

When a start key of the image forming apparatus 300 is pressed, the scanner 200 reads a document, converts read data into image data, and sends image data to the apparatus body 100. In this time, when imaging operation is started, the photoreceptor 2 of each of the process units 1Y, 1C, 1M, and 1Bk is rotated counterclockwise in FIG. 1, and the charging roller 3 uniformly charges the surface of the photoreceptor 2 with a predetermined polarity. Based on the image data of the document read by the scanner 200, the exposure device 6 irradiates laser light onto the charged surface of the photoreceptor 2 to form an electrostatic latent image on the surface of the photoreceptor 2.

At this time, image information exposed to each photoreceptor 2 is single-color image information obtained by separating a desired full-color image into single-color information on yellow, cyan, magenta, and black. Each developing device 4 supplies toner onto the electrostatic latent image formed on the photoreceptor 2, thus making the electrostatic latent images a visible image as a toner image.

One of the first stretching roller 21, the second stretching roller 22, and the third stretching roller 23 over which the intermediate transfer belt 10 is stretched is driven for rotation to circulate the intermediate transfer belt 10 in the clockwise direction indicated by arrow R in FIG. 1. A voltage having a polarity opposite a charged polarity of toner and subjected to constant voltage or current control is supplied to each of the primary transfer rollers 11. As a result, a transfer electric field is formed at the primary transfer nip between each primary transfer roller 11 and the opposing photoreceptor 2. Toner images of respective colors on the photoreceptors 2 are primarily transferred one on another onto the intermediate transfer belt 10 by the transfer electric fields formed at the primary transfer nips. Thus, the intermediate transfer belt 10 bears a full-color toner image on the surface of the intermediate transfer belt 10. Residual toner remaining on each photoreceptor 2 without being transferred onto the intermediate transfer belt 10 is removed with the cleaning blade 5.

With rotation of the feed roller 14, a sheet S is fed from the corresponding feed tray 13. The sheet S is further sent to the secondary transfer nip between the secondary transfer roller 12 and the intermediate transfer belt 10 by the registration rollers 15 so as to synchronize with the full-color toner image on the intermediate transfer belt 10. At this time, a transfer voltage of the polarity opposite the charged polarity of toner of the toner image on the intermediate transfer belt 10 is supplied to the secondary transfer roller 12. As a result, a transfer electric field is formed at the secondary transfer nip. By the transfer electric field formed at the secondary transfer nip, the toner image on the intermediate transfer belt 10 is secondarily transferred collectively onto the sheet S.

Then, the sheet S is sent into the fixing device 8, and the fixing roller 17 and the pressing roller 18 apply heat and pressure to fix the toner image on the sheet S. After the sheet S heated to an increased temperature by the fixing device 8 is cooled with the cooling device 9, the paired discharge rollers 16 discharge the sheet S from the apparatus body 100 onto the discharge tray 20.

The above description relates to image forming operation for forming a full color image on a sheet S. Alternatively, a single color image can be formed by any one of the process units 1Y, 1C, 1M, and 1Bk, or a composite color image of two or three colors can be formed by two or three of the process units 1Y, 1C, 1M, and 1Bk.

As illustrated in FIG. 2, the cooling device 9 includes a sheet conveyor 30 to convey a sheet S heated at a fixing nip of the fixing device 8 while sandwiching the sheet S from a first side (hereinafter, upper side) on which fused toner immediately after fixing of the sheet S adheres and a second side (hereinafter, lower side) opposite the first side. The sheet conveyor 30 includes an upper-side belt driving unit 31 serving as a first belt driving unit including an upper-side conveyance belt 56 serving as a first conveyance belt to sandwich the sheet S from the front-face side of the sheet S. The sheet conveyor 30 also includes a lower-side belt driving unit 32 serving as a second belt driving unit including a lower-side conveyance belt 59 serving as a second conveyance belt to sandwich the sheet s from the back-face side of the sheet S. As described above, the sheet conveyor 30 includes the upper-side conveyance belt 56 and the lower-side conveyance belt 59 serving as a pair of opposed conveyance belts.

At the inner circumferential side of the stretching surface of the upper-side conveyance belt 56 to sandwich the sheet S, an upper-side cooling member 33*a* is arranged to contact the upper-side conveyance belt 56 endlessly moved. The upper-side cooling member 33*a* serves as a cooling member to absorb heat of and cool the sheet S via the upper-side conveyance belt 56. At the inner circumferential side of the stretching surface of the lower-side conveyance belt 59 to sandwich the sheet S, a lower-side cooling member 33*b* is arranged to contact the lower-side conveyance belt 59 endlessly moved. The lower-side cooling member 33*b* serves as a cooling member to absorb heat of and cool the sheet S via the lower-side conveyance belt 59.

The upper-side cooling member 33*a* and the lower-side cooling member 33*b* (collectively referred to as "cooling members 33" unless distinguished) are arranged offset from each other in the conveyance direction of the sheet S. The upper-side cooling member 33*a* has, as a lower surface, an upper-side heat absorbing surface 34*a* of an arc surface shape slightly protruding downward. The lower-side cooling member 33*b* has, as an upper surface, a lower-side heat absorbing surface 34*b* of an arc surface shape slightly protruding upward. Each of the upper-side cooling member 33*a* and the lower-side cooling member 33*b* includes an internal channel (cooling-liquid channel) through which cooling liquid flows.

Each of the upper-side cooling member 33*a* and the lower-side cooling member 33*b* is arranged to shift along the conveyance direction of the sheet S. Specifically, the upper-side cooling member 33*a* is arranged to shift to a downstream side in the conveyance direction of the sheet S and the lower-side cooling member 33*b* is arranged to shift to an upstream side in the conveyance direction of the sheet S. The arrangement of the cooling members 33 is not limited to that of the above-described embodiment and may be any other suitable arrangement in accordance with design conditions. The upper-side cooling member 33*a* has, as the lower surface, the upper-side heat absorbing surface 34*a* of an arc surface shape slightly protruding downward. The lower-side cooling member 33*b* has, as the upper surface, the lower-side heat absorbing surface 34*b* of an arc surface shape slightly protruding upward. Each of the cooling members 33 includes an internal channel (cooling-liquid channel) through which cooling liquid flows.

As illustrated in FIG. 3, the cooling device 9 is a liquid cooling type of cooling device and includes a cooling-liquid circuit 44. The cooling-liquid circuit 44 includes a heat receiving part 45 to receive heat from a sheet S in high temperature state, a heat dissipating part 46 to radiate heat of the heat receiving part 45, and a circulation channel 47 to circulate cooling liquid through the heat receiving part 45 and the heat dissipating part 46. The circulation channel 47 includes a pump 48 to circulate cooling liquid and a liquid tank 49 to store cooling liquid. Each of the cooling members 33 acts as the heat receiving part 45. The heat dissipating part 46 includes, e.g., a radiator. As the cooling liquid, for example, a cooling liquid is employed that includes water as main ingredient, propylene glycol or ethylene glycol to decrease the freezing point, and antirust (e.g., phosphate material, such as phosphoric-acid potassium salt or inorganic potassium salt) to prevent rust of metal components.

The circulation channel 47 includes a first pipe 50, a second pipe 51, a third pipe 52, a fourth pipe 53, and a fifth pipe 54. The first pipe 50 connects an upper-side inlet 41*a* of the upper-side cooling member 33*a* to the radiator serving as the heat dissipating part 46. The second pipe 51 connects an upper-side inlet 42*a* of the upper-side cooling member 33*a* to a lower-side inlet 41*b* of the lower-side cooling member 33*b*. The third pipe 52 connects a lower-side outlet 42*b* of the lower-side cooling member 33*b* to the liquid tank 49. The fourth pipe 53 connects the liquid tank 49 to the pump 48. The fifth pipe 54 connects the pump 48 to the radiator serving as the heat dissipating part 46.

The upper-side belt driving unit 31 includes multiple upper-side stretching rollers 55*a*, 55*b*, 55*c*, and 55*d* (e.g., four rollers in a configuration illustrated in FIG. 3) and the upper-side conveyance belt 56 wound around the upper-side stretching rollers 55. The lower-side belt driving unit 32 includes multiple lower-side stretching rollers 57*a*, 57*b*, 57*c*, and 57*d* (e.g., four driven rollers in a configuration illustrated in FIG. 3) and the lower-side conveyance belt 59 wound around the lower-side stretching rollers 57. Here, the upper-side stretching roller 55*a* is a driving roller to rotate the upper-side conveyance belt 56, and the three upper-side stretching rollers 55*b*, 55*c*, and 55*d* are driven rollers. Here, the lower-side stretching rollers 57 is a driving roller to rotate the lower-side conveyance belt 59, and the three lower-side stretching rollers 57*b*, 57*c*, and 57*d* are driven rollers.

Accordingly, the sheet S is conveyed and sandwiched with the upper-side conveyance belt 56 of the upper-side belt driving unit 31 and the lower-side conveyance belt 59 of the lower-side belt driving unit 32. In other words, when the lower-side stretching roller 57*a* serving as the driving roller is rotated, as illustrated in FIG. 2, the lower-side conveyance belt 59 is endlessly moved in a direction indicated by arrow A. As described in detail below, the lower-side belt driving unit 32 includes a second gear to engage a first gear coupled to the upper-side stretching roller 55*a* and transmit a rotation driving force transmitted from a driving motor serving as a driving source to the lower-side stretching roller 57*a*. The first gear engaging the second gear transmits the rotation driving force of the driving motor to the upper-side stretching roller 55*a* so that a portion of the upper-side conveyance belt 56 opposing the lower-side conveyance belt 59 endlessly moves in the same direction and speed as the lower-side conveyance belt 59. Accordingly, with endless movement of the lower-side conveyance belt 59 of the lower-side belt driving unit 32, the upper-side conveyance belt 56 of the upper-side belt driving unit 31 endlessly moves in a direction indicated by arrow B, and the sheet S is conveyed from an upstream side to a downstream side in a direction indicated by arrow C.

Next, operation of the cooling device 9 thus configured is described below.

When the sheet S is sandwiched and conveyed, as illustrated in, e.g., FIG. 2, the upper-side belt driving unit 31 and the lower-side belt driving unit 32 are placed in proximity to each other. In a state illustrated in FIG. 2, when the lower-side stretching roller 57*a* serving as the driving roller of the lower-side belt driving unit 32 is rotated, as described above, the upper-side conveyance belt 56 and the lower-side conveyance belt 59 travel in the direction B and the direction A, respectively, and the sheet S travels in the direction C. In such a state, cooling liquid is circulated in the cooling-liquid circuit 44. In other words, the pump 48 is activated to flow the cooling liquid through the internal channel of each of the upper-side cooling member 33*a* and the lower-side cooling member 33*b*.

At this time, an inner circumferential surface of the upper-side conveyance belt 56 of the upper-side belt driving unit 31 slides over the upper-side heat absorbing surface 34*a* of the upper-side cooling member 33*a*, and an inner circumferential surface of the lower-side conveyance belt 59 of the lower-side belt driving unit 32 slides over the lower-side heat absorbing surface 34*b* of the lower-side cooling member 33*b*. From a back face (lower face) side of the sheet S, the lower-side cooling member 33*b* absorbs heat of the sheet S via the lower-side conveyance belt 59. From a front face (upper face) side of the sheet S, the upper-side cooling member 33*a* absorbs heat of the sheet S via the upper-side conveyance belt 56. In such a case, the cooling liquid transports an amount of heat absorbed by the upper-side cooling member 33*a* and the lower-side cooling member 33*b* to the outside, thus maintaining the upper-side cooling member 33*a* and the lower-side cooling member 33*b* at relatively low temperature.

In other words, when the pump 48 is activated, the cooling liquid circulates in the cooling-liquid circuit 44. When the cooling liquid flows through the internal channel of each of the upper-side cooling member 33*a* and the lower-side cooling member 33*b*, the cooling liquid absorbs heat from the cooling members 33 and increases in temperature. When the cooling liquid passes through the radiator serving as the heat dissipating part 46, an amount of heat of the cooling liquid at increased temperature is radiated to ambient atmosphere. As a result, the temperature of the cooling liquid decreases. The cooling liquid at decreased temperature flows through the internal channel of each of the upper-side cooling member 33*a* and the lower-side cooling member 33*b* again, and transports an amount of heat absorbed by the upper-side cooling member 33*a* and the lower-side cooling member 33*b*, to the radiator serving as the heat dissipating part 46. By repeating the above-described cycle, the sheet S is cooled from both sides thereof via the upper-side conveyance belt 56 and the lower-side conveyance belt 59.

With such a configuration, the cooling device 9 cools sheets S, thus preventing the sheets S from being stacked on the discharge tray 20 at high temperature. Such a configuration effectively prevents blocking, thus allowing sheets S to be stacked on the discharge tray 20 without adhering to each other.

In the above-described embodiment, the cooling device 9 includes two cooling members, that is, the upper-side cooling member 33*a* and the lower-side cooling member 33*b*. It is to be noted that the configuration of the cooling device in this disclosure is not limited to the above-described embodiment but may be any other suitable configuration. For example, as illustrated in FIG. 4, in an embodiment, a cooling device 9 may have three cooling members, that is, one upper-side cooling member 33*a* and two lower-side cooling members 33*b*. In the above-described embodiment, the cooling device 9 is a liquid cooling type cooling device. However, the configuration of the cooling device is not limited to the above-described cooling type. For example, as illustrated in FIG. 5, in an embodiment, a cooling device 9 may be an air cooling type cooling device that includes three cooling members, that is, one upper-side cooling member 33*a* and two lower-side cooling members 33*b*, and cooling fins 61 provided with the respective cooling members to serve as a portion having a shape of facilitating heat radiation. As described above, use of an air-cooling heat sink structure obviates use of the cooling-liquid circuit 44, thus allowing downsizing and cost reduction of the cooling device.

Next, opening and closing (movement) operation of the sheet conveyor 30 performed during, e.g., sheet jam processing or maintenance work of the cooling device 9 according to this embodiment of this disclosure is described with reference to FIGS. 6, 7, 8A, 8B, 9A, and 9B.

Figure 6:
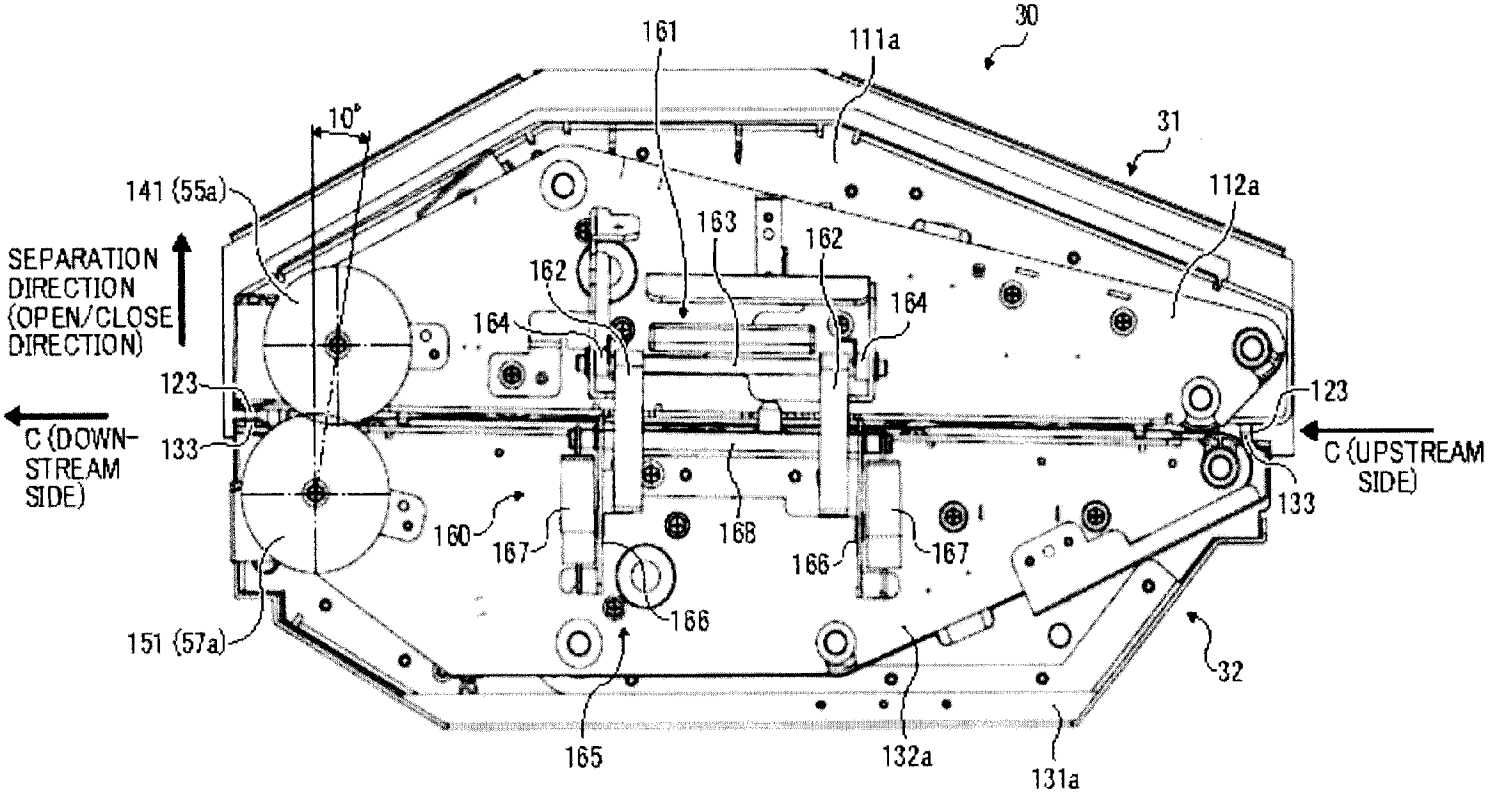
FIG. 6 is a schematic view of a sheet conveyor in sandwich state according to an embodiment of this disclosure, seen from a front-face side of a cooling device.
Figure 7:
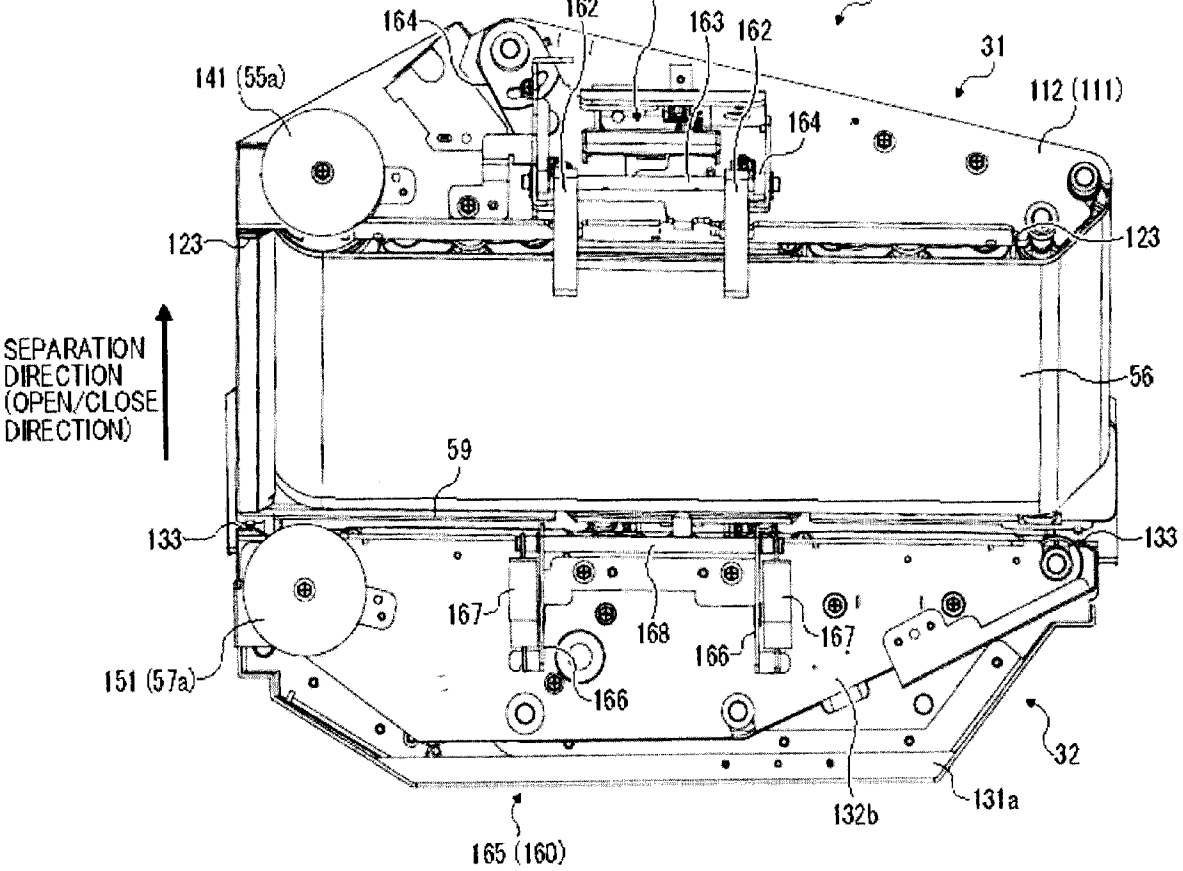
FIG. 7 is a schematic view of the sheet conveyor in separation state, seen from a front-face side of the cooling device.
Figure 8A:
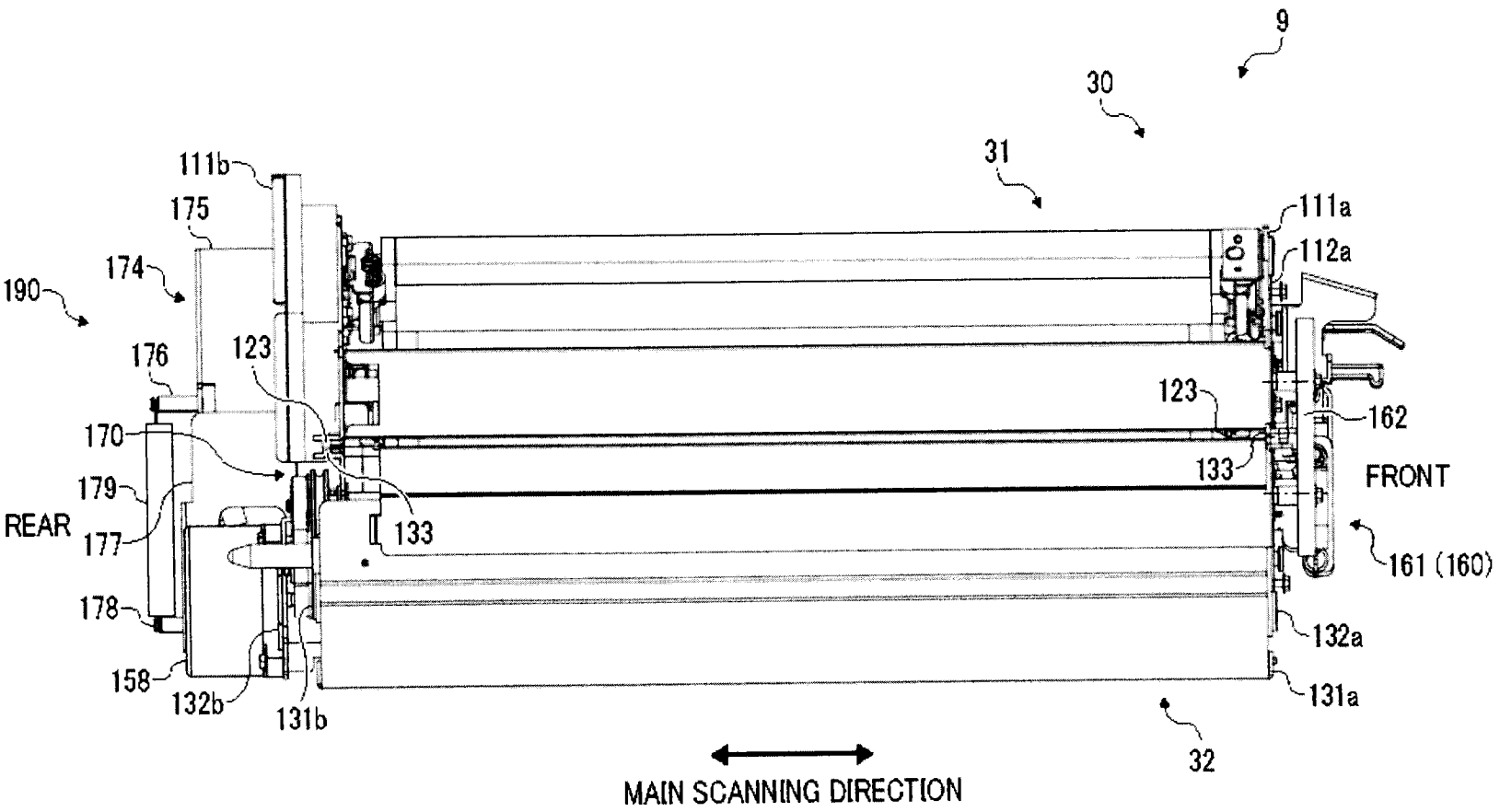
FIGS. 8A and 8B are schematic views of the sheet conveyor, seen from a lateral face side of the cooling device.
Figure 8B:
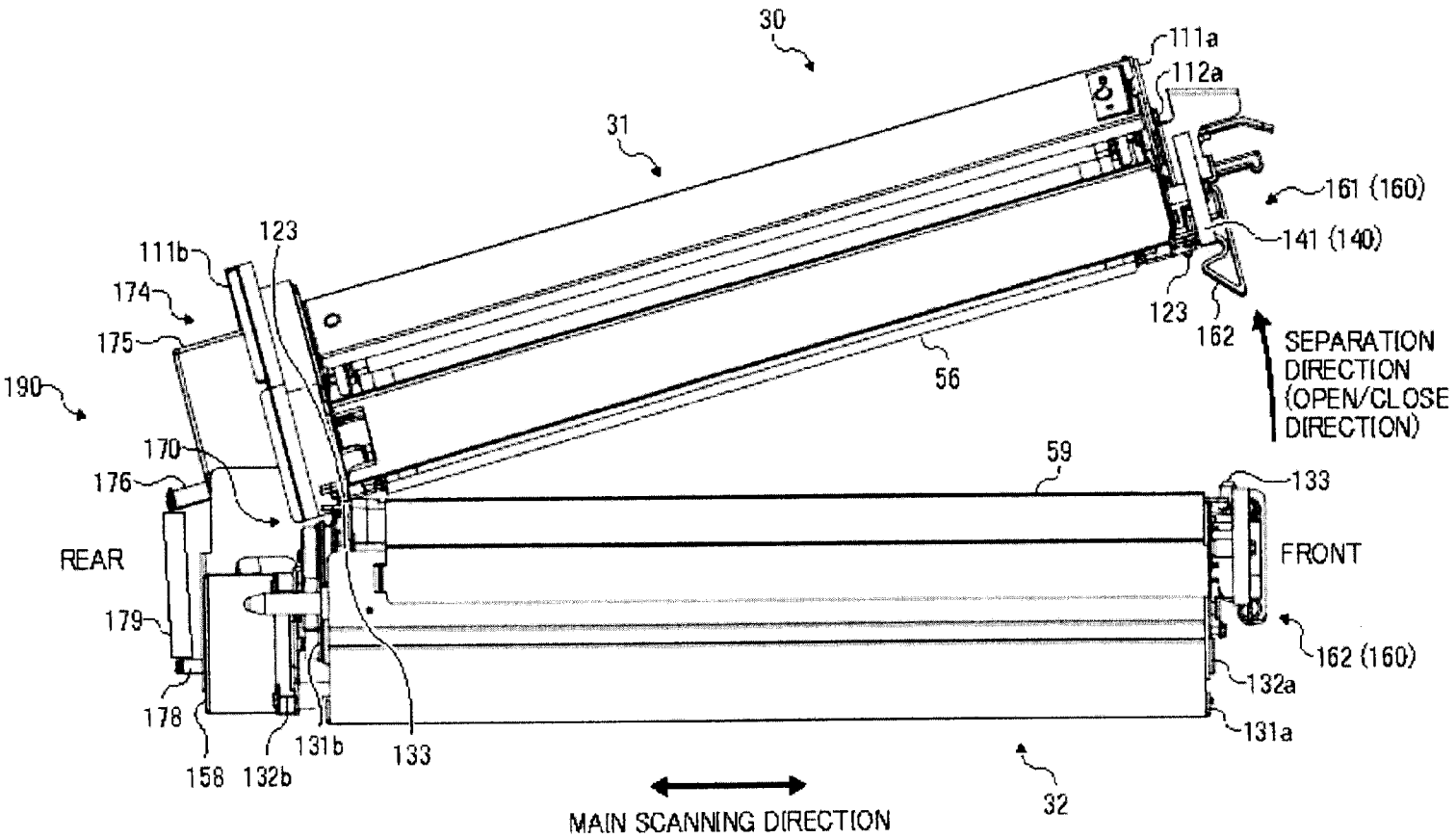
Figure 9A:
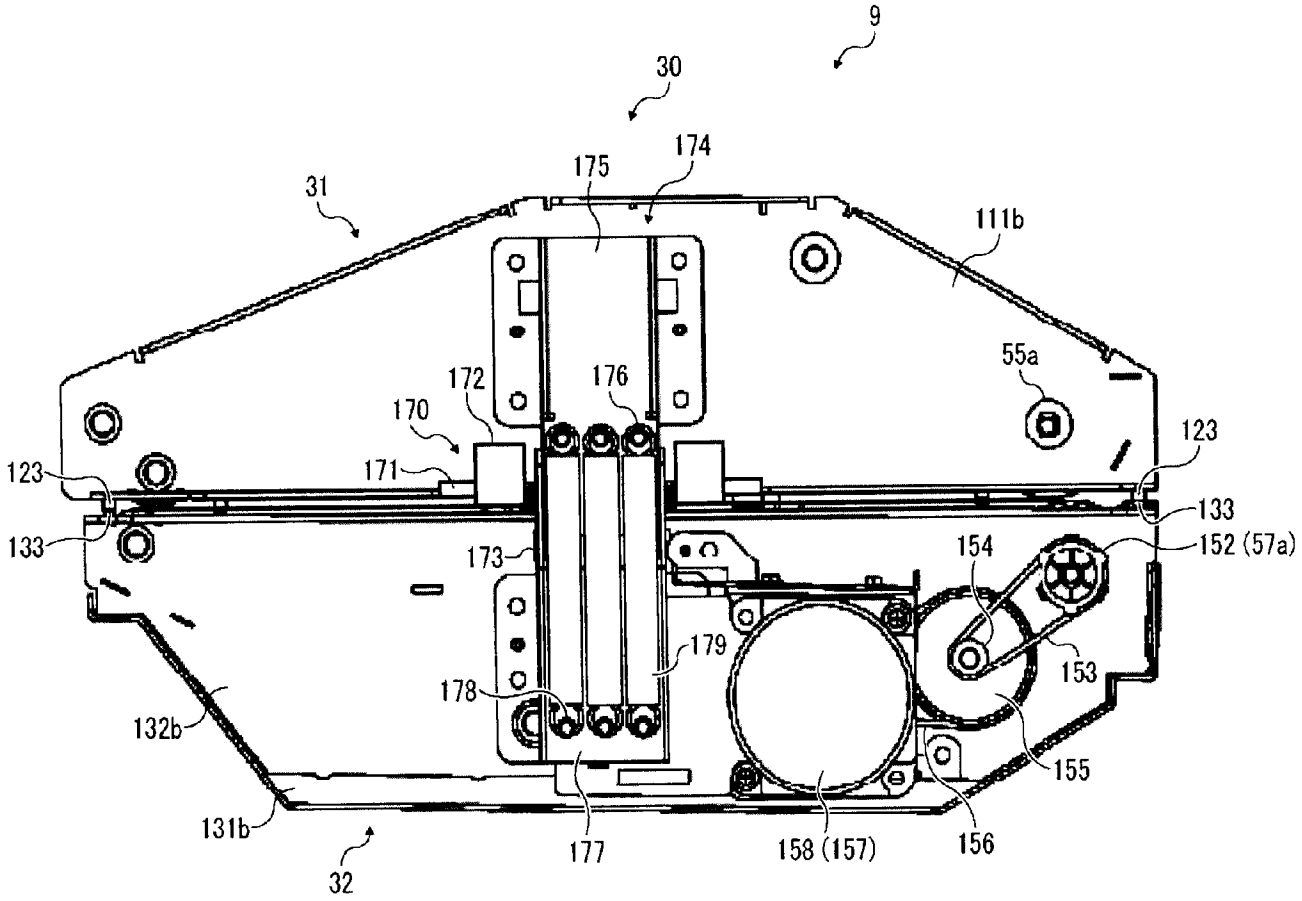
FIGS. 9A and 9B are schematic views of the sheet conveyor, seen from a rear-face side of the cooling device.
Figure 9B:
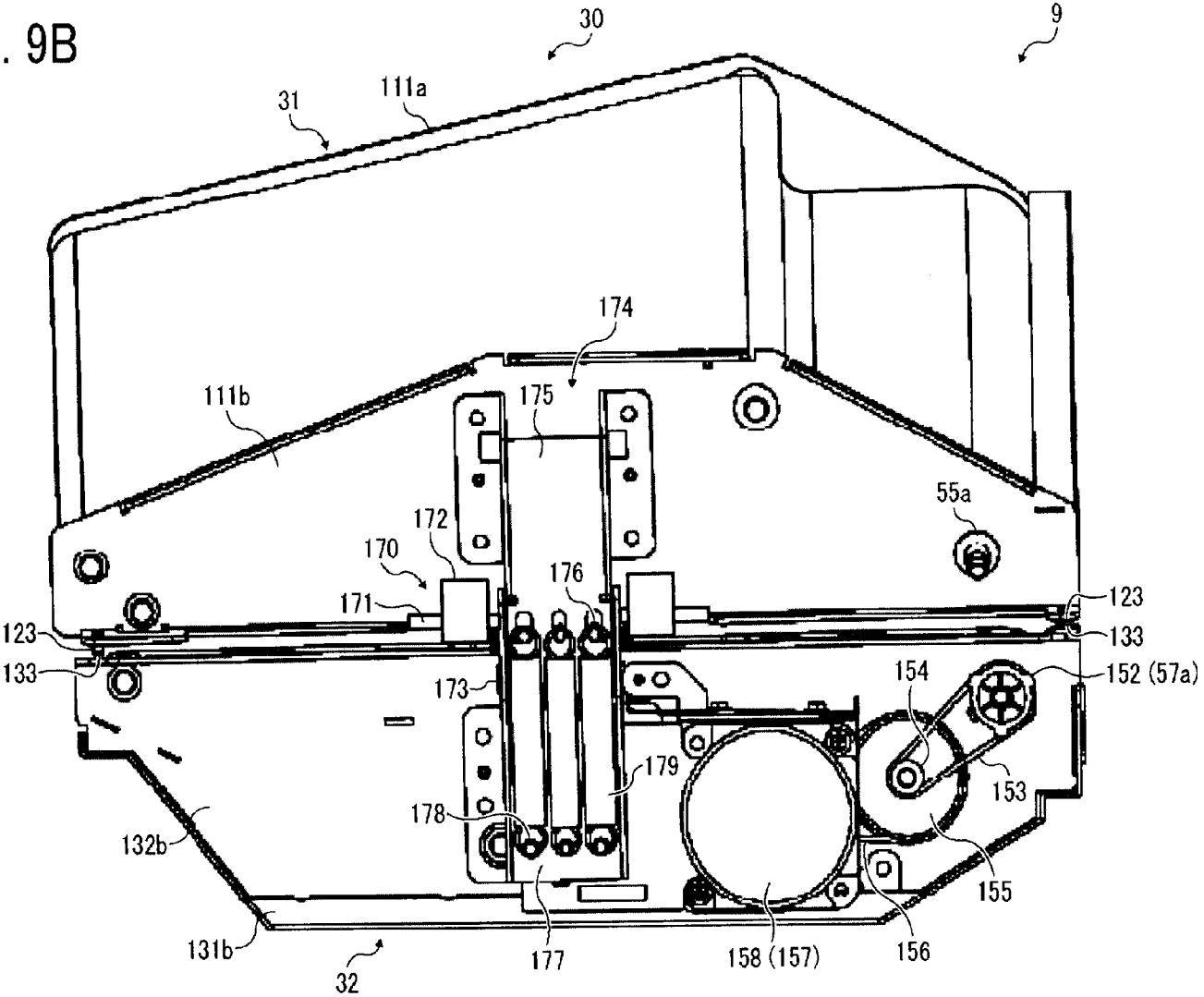

FIG. 6 is a front view of the sheet conveyor 30 in the sandwich state, seen from a front-face side of the cooling device 9. FIG. 7 is a front view of the sheet conveyor 30 in the separation state, seen from the front-face side of the cooling device 9. FIG. 8A is a side view of the sheet conveyor 30 in the sandwich state, seen from a lateral face side of the cooling device 9. FIG. 8B is a side view of the sheet conveyor 30 in the separation state, seen from a lateral face side of the cooling device 9. FIG. 9A is a back view of the sheet conveyor 30 in the sandwich state, seen from a rear-face side of the cooling device 9. FIG. 9B is a back view of the sheet conveyor 30 in the separation state, seen from the rear-face side of the cooling device 9.

As illustrated in FIGS. 6 through 9B, for the sheet conveyor 30 according to this embodiment, the upper-side belt driving unit 31 including the upper-side conveyance belt 56 is openable and closable relative to the lower-side belt driving unit 32 including the lower-side conveyance belt 59 during, e.g., sheet jam processing or maintenance work. For example, while switching two rotation centers substantially parallel to the sheet conveyance direction (indicated by arrow C in FIG. 6) in which the sheet S is conveyed in sandwiched state, an opposed end side opposite a rear-face side of the cooling device 9 which is one end side of the rotation shaft of each of the upper-side stretching rollers 55 of the upper-side belt driving unit 31 is rotated to open and close the upper-side belt driving unit 31 relative to the lower-side belt driving unit 32. It is to be noted that, as described in detail, two rotation centers are substantially parallel to the sheet conveyance direction (indicated by arrow C in FIG. 6) in which the sheet S is conveyed in sandwiched state. Accordingly, the shaft center of the rotation shaft of each of the upper-side stretching rollers 55 of the upper-side belt driving unit 31 and a first drive transmission gear 141 serving as the first gear parallel to each upper-side stretching roller 55 moves on a plane substantially perpendicular to the sheet conveyance direction C. An intermediate position at which the two rotation centers are switched is disposed between a separation position at which the upper-side belt driving unit 31 stops in a separation state at which the upper-side belt driving unit 31 is fully opened relative to the lower-side belt driving unit 32 and a sandwich position at which the upper-side belt driving unit 31 stops in a sandwich state in which the upper-side belt driving unit 31 is fully closed relative to the lower-side belt driving unit 32.

The upper-side belt driving unit 31 rotatably holds the upper-side stretching rollers 55 over which the upper-side conveyance belt 56 is stretched, with a first upper-side holding plate 111*a* at the front-face side of the cooling device 9, a second upper-side holding plate 111*b* at the rear-face side of the cooling device 9, and a frame member. The lower-side belt driving unit 32 rotatably holds the lower-side stretching rollers 57 over which the lower-side conveyance belt 59 is stretched, with a first lower-side holding plat 131*a* at the front-face side of the cooling device 9, a second lower-side holding plat 131*b* at the rear-face side of the cooling device 9, and a frame member. It is to be noted that the upper-side belt driving unit 31 and the lower-side belt driving unit 32 includes tension assemblies allowing the upper-side stretching roller 55*b* and the lower-side stretching roller 57*b* to function as tension rollers. The upper-side stretching roller 55*b* and the lower-side stretching roller 57*b* stretch the upper-side conveyance belt 56 and the lower-side conveyance belt 59, respectively, at positions downstream from the upper-side stretching roller 55*a* and the lower-side stretching roller 57*a* serving as the driving rollers in the sheet conveyance direction. In maintenance operation, such as replacement of the conveyance belts, a tension belt applying tension to a target one of the conveyance belts is retracted from a stretching position, thus facilitating replacement of the target conveyance belt.

Each of the first upper-side holding plate 111*a* and the second upper-side holding plate 111*b* of the upper-side belt driving unit 31 and the first lower-side holding plat 131*a* and the second lower-side holding plat 131*b* of the lower-side belt driving unit 32 includes regulating protrusions at opposed ends of a sheet conveyance face side thereof to regulate the sandwich position at which the upper-side conveyance belt 56 and the lower-side conveyance belt 59 are placed in the sandwich state. For example, each of the first upper-side holding plate 111*a* and the second upper-side holding plate 111*b* has upper-side restriction protrusions 123 at the opposed ends of the sheet conveyance face side of the second upper-side holding plate 111*b*. Each of the first lower-side holding plat 131*a* and the second lower-side holding plat 131*b* has lower-side restriction protrusions 133 at the opposed ends of the sheet conveyance face side of the second lower-side holding plat 131*b*. The upper-side restriction protrusions 123 and the lower-side restriction protrusions 133 restrict the sandwich positions of the upper-side belt driving unit 31 and the lower-side belt driving unit 32, respectively, thus regulating a space between the upper-side conveyance belt 56 and the lower-side conveyance belt 59 in the sandwich state.

During closing operation of rotating the upper-side belt driving unit 31 from the separation position to the sandwich position, the upper-side restriction protrusions 123 at the rear-face side of the cooling device 9 contact the lower-side restriction protrusions 133 at the rear-face side of the cooling device 9 on an intermediate position line, which is a line parallel to the sheet conveyance direction in which the sheet S is conveyed in sandwiched state, earlier than the upper-side restriction protrusions 123 at the front-face side of the cooling device 9 contact the lower-side restriction protrusions 133 at the front-face side of the cooling device 9. The closing operation proceeds while the intermediate position line on which the upper-side restriction protrusions 123 at the rear-face side of the cooling device 9 contact the lower-side restriction protrusions 133 at the rear-face side of the cooling device 9 acts as a center of rotation. The upper-side restriction protrusions 123 at the front-face side of the cooling device 9 contact the lower-side restriction protrusions 133 at the front-face side of the cooling device 9, thus restricting the rotation of the upper-side belt driving unit 31 at the sandwich position. In other words, a portion at which the upper-side restriction protrusions 123 at the rear-face side of the cooling device 9 contact the lower-side restriction protrusions 133 at the rear-face side of the cooling device 9 on the intermediate position line forms a second rotation fulcrum (second rotation axis) which is one of the above-described two rotation centers. The upper-side restriction protrusions 123 and the lower-side restriction protrusions 133 at opposed ends of each of the second upper-side holding plate 111*b* and the second lower-side holding plat 131*b* are part of a rotation unit 170 of the following movement assembly 190. The intermediate position is a position of the upper-side belt driving unit 31 at which the upper-side belt driving unit 31 starts rotating around the second rotation fulcrum formed by the upper-side restriction protrusions 123 and the lower-side restriction protrusions 133 in closing operation and switches the rotation fulcrum from the second rotation fulcrum to a first rotation fulcrum in opening operation.

The cooling device 9 also includes the movement assembly 190 to move the upper-side belt driving unit 31 between the sandwich position at which the upper-side conveyance belt 56 and the lower-side conveyance belt 59 are placed in the sandwich state and the separation position at which the upper-side conveyance belt 56 and the lower-side conveyance belt 59 are placed in the separation state. The movement assembly 190 includes the rotation unit 170 extended over the second upper-side holding plate 111*b* and the second lower-side holding plat 131*b* at the rear-face side of the cooling device 9, which is one end side of each of the upper-side belt driving unit 31 and the lower-side belt driving unit 32 in a rotation axis direction of the lower-side stretching roller 57*a*. The rotation unit 170 holds the upper-side belt driving unit 31 relative to the lower-side belt driving unit 32 in such a manner that the upper-side belt driving unit 31 is rotatable around the first rotation fulcrum substantially parallel to the sheet conveyance direction in which the sheet S is conveyed in sandwiched state and the second rotation fulcrum. For example, besides the upper-side restriction protrusions 123 and the lower-side restriction protrusions 133 at the opposed ends of each of the second upper-side holding plate 111*b* and the second lower-side holding plat 131*b* that form the second rotation fulcrum, the movement assembly 190 has the following configuration forming the first rotation fulcrum.

The second lower-side holding plat 131*b* has a shaft holding member 173 partially protruding toward the second upper-side holding plate 111*b*. In the vicinity of an end of the shaft holding member 173 protruding toward the second upper-side holding plate 111*b*, a pair of side plates having an arcuate slit to hold a rotation shaft 171 substantially parallel to the sheet conveyance direction in such a manner that the rotation shaft 171 is rotatable around the second rotation fulcrum, thus holding the rotation shaft 171 in such a manner that the rotation shaft 171 is movable along the arcuate slit. The second upper-side holding plate 111*b* is provided with hole holding members 172 including holes to rotatably fit the opposed ends of the rotation shaft 171. The hole holding members 172 form the first rotation fulcrum around which the upper-side belt driving unit 31 rotates between the separation position and the above-described intermediate position. In other words, the rotation unit 170 serving as a hinge assembly is constituted of the upper-side restriction protrusions 123 and the lower-side restriction protrusions 133 at the rear-face side of the cooling device 9 that form the second rotation fulcrum, the hole holding member 172 serving as the first rotation fulcrum, the shaft holding member 173, and the rotation shaft 171.

The movement assembly 190 further includes an opening-direction urging unit 174 to generate urging force in an opening direction to rotate the upper-side belt driving unit 31 from the sandwich position to the separation position. Such a configuration reduces operator's load in rotating the upper-side belt driving unit 31 with the rotation unit 170 in the opening direction. When the upper-side belt driving unit 31 rotates to the separation position, the opening-direction urging unit 174 maintains the upper-side belt driving unit 31 at the separation position with the urging force. The opening-direction urging unit 174 includes an upper-side bracket 175 fixed at the second upper-side holding plate 111*b*, a lower-side bracket 177 fixed at the second lower-side holding plat 131*b*, and rear-face side coil springs 179 which are three extension coil springs. The opening-direction urging unit 174 further includes upper-side arms 176 and lower-side arms 178. The upper-side arms 176 are arranged in the vicinity of an end of the upper-side bracket 175 to protrude toward the back-face side beyond the end of the upper-side bracket 175. The lower-side arms 178 are arranged in the vicinity of an end of the lower-side bracket 177 to protrude toward the back-face side beyond the end of the lower-side bracket 177. The rear-face side coil springs 179 are supported with protruding ends of the upper-side arms 176 and protruding ends of the lower-side arms 178.

The movement assembly 190 includes a lock assembly 160 to maintain the position of the upper-side belt driving unit 31 rotated to the sandwich position by the rotation unit 170. The lock assembly 160 is extended over the first upper-side holding plate 111*a* and the first lower-side holding plat 131*a* at the front-face side of the cooling device 9. For example, for the upper-side belt driving unit 31, an upper-side lock unit 161 is mounted on an upper-side mount plate 112*a* that is mounted on a front-face side of the first upper-side holding plate 111*a*. For the lower-side belt driving unit 32, a lower-side lock unit 165 is mounted on a first lower-side mount plate 132*a* that is mounted on a front-face side of the first lower-side holding plat 131*a*.

The lower-side lock unit 165 includes an engagement shaft 168 parallel to the sheet conveyance direction. The upper-side lock unit 161 includes two engagement arms 162 serving as an engagement unit to engage the engagement shaft 168 to hold the position of the upper-side belt driving unit 31 when the upper-side belt driving unit 31 is in the sandwich position. The engagement arms 162 are fixed at an arm shaft 163 rotatably held by holes of two arm mount stays 164. The arm mount stays 164 are arranged parallel to a rotation direction of the upper-side belt driving unit 31. The engagement arms 162 have hooked ends to move the engagement shaft 168 toward the upper-side belt driving unit 31 when the engagement arms 162 engage the engagement shaft 168. By urging force of lock springs 167 which are extension coil springs to move the engagement shaft 168 to the lower-side belt driving unit 32, engagement of the engagement arms 162 and the engagement shaft 168 further proceeds and completes at internal corner parts of hooked shape of the engagement arms 162. When engagement of the engagement arms 162 and the engagement shaft 168 is completed, the upper-side belt driving unit 31 is maintained at the sandwich position. By contrast, when the engagement arms 162 are rotated for disengagement in a direction opposite a direction in which the engagement arms 162 are rotated for engagement, an operator can rotate the engagement arms 162 by applying force only to the engagement arms 162. Alternatively, the operator can rotate the engagement arms 162 by applying force to the engagement arms 162 while moving the engagement shaft 168 toward the upper-side belt driving unit 31.

The lower-side lock unit 165 includes the engagement shaft 168 parallel to the sheet conveyance direction. The two engagement arms 162 of the upper-side lock unit 161 engage the engagement arms 162 when the upper-side belt driving unit 31 is in the sandwich position. Two shaft mount stays 166 having slits are arranged in parallel to the rotation direction of the upper-side belt driving unit 31. The engagement shaft 168 are held by the slits of the shaft mount stays 166 to be reciprocally movable toward and back from the upper-side lock unit 161. The engagement shaft 168 is urged by the urging force of the lock springs 167 in a direction away from the upper-side belt driving unit 31.

In the upper-side belt driving unit 31, the first drive transmission gear 141 serving as the first gear to transmit the rotation driving force to the upper-side stretching roller 55*a* is arranged in such a manner that the rotation shaft of the first drive transmission gear 141 is substantially parallel to the rotation shaft of the upper-side stretching roller 55*a*. The lower-side belt driving unit 32 includes a second drive transmission gear 151 serving as the second gear to engage the first drive transmission gear 141 and transmit, to the first drive transmission gear 141, rotation driving force of a driving motor 158 serving as a driving source to rotate the lower-side stretching roller 57*a*. The second drive transmission gear 151 is arranged in such a manner that a rotation shaft of the second drive transmission gear 151 is substantially parallel to the rotation shaft of the lower-side stretching roller 57*a*. As described above, the rotation unit 170 is disposed at one end side of the upper-side stretching roller 55*a* and the lower-side stretching roller 57*a*. The first drive transmission gear 141 and the second drive transmission gear 151 are disposed at an opposed end side opposite the one end side so as to engage each other when the upper-side belt driving unit 31 is in the sandwich position. In FIGS. 6 and 7, a circular end of each of the first drive transmission gear 141 and the second drive transmission gear 151 is illustrated.

For example, as illustrated in FIGS. 8A and 8B, the driving motor 158 serving as the driving source is fixed on a second lower-side mount plate 132*b* that is mounted on a rear-face side of the second lower-side holding plat 131*b*. As illustrated in FIGS. 9A and 9B, a large-diameter gear 155 is coupled to an output gear 157 of the driving motor 158 via a first timing belt 156. A small-diameter gear 154 is fixed to the large-diameter gear 155 so as to coaxially rotate with the large-diameter gear 155. The small-diameter gear 154 is coupled via a second timing belt 153 to a driving gear 152 fixed to the rotation shaft of the lower-side stretching roller 57*a* at the rear-face side. As illustrated in FIGS. 6 and 7, the second drive transmission gear 151 is secured at the front-face side which is the opposed end side of the rotation shaft of the lower-side stretching roller 57*a*.

As illustrated in FIG. 6, when the upper-side belt driving unit 31 is at the sandwich position, the first drive transmission gear 141 of the upper-side belt driving unit 31 engages the second drive transmission gear 151 of the lower-side belt driving unit 32. In such an engagement state, the upper-side conveyance belt 56 and the lower-side conveyance belt 59 are endlessly moved at the same direction and speed in a part sandwiching the sheet S. Thus, the sheet S is conveyed in sandwiched state in the direction indicated by arrow C in FIG. 2. As described above, with the first drive transmission gear 141 and the second drive transmission gear 151 engaged each other, the upper-side conveyance belt 56 and the lower-side conveyance belt 59 are endlessly moved at the same speed, thus preventing slippage of each conveyance belt. As illustrated in FIG. 7, in the opening operation of rotating the upper-side belt driving unit 31 to the separation position at which the upper-side belt driving unit 31 is separated from the lower-side belt driving unit 32, engagement of the second drive transmission gear 151 and the first drive transmission gear 141 is released with the opening operation.

Next, an arrangement of the paired driving gears to engage and disengage in response to opening and closing operation of the sheet conveyor 30 according to this embodiment of this disclosure is described with reference to FIGS. 10A to 10D.

Figure 10A:
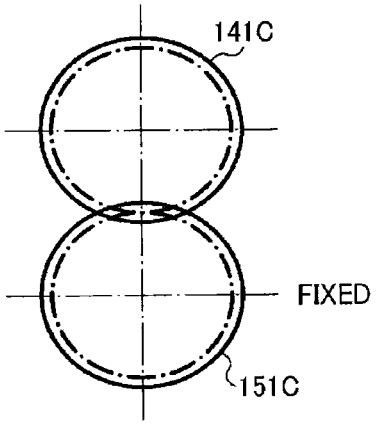
FIGS. 10A through 10D are schematic views of paired drive transmission gears to engage and disengage from each other according to a comparative example.
Figure 10B:
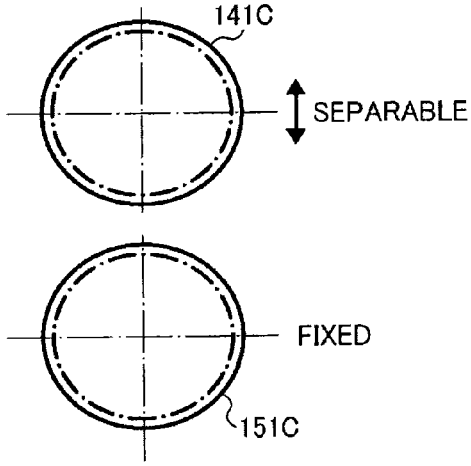
Figure 10C:
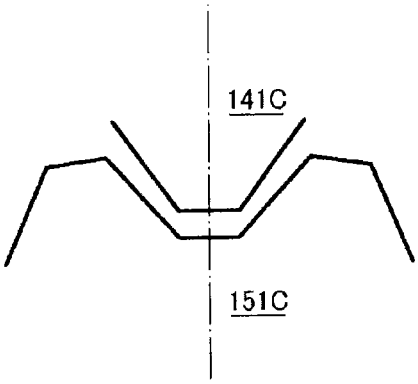
Figure 10D:
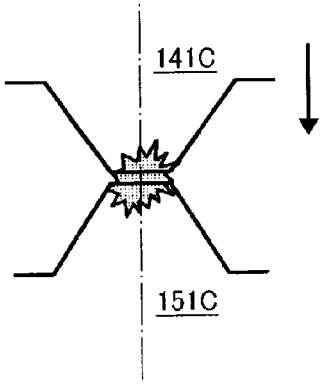

FIGS. 10A to 10D are views of an arrangement of paired drive transmission gears 141C and 151C according to a comparative example of this disclosure. FIG. 10A is a view of the paired drive transmission gears 141C and 151C in engaged state. FIG. 10B is a view of the paired drive transmission gears 141C and 151C in disengaged (separated) state. FIG. 10C is an enlarged view of a normal engagement state of an engagement part of the paired drive transmission gears 141C and 151C. FIG. 10D is an enlarged view of an abnormal engagement state of the paired drive transmission gears 141C and 151C.

Figure 11A:
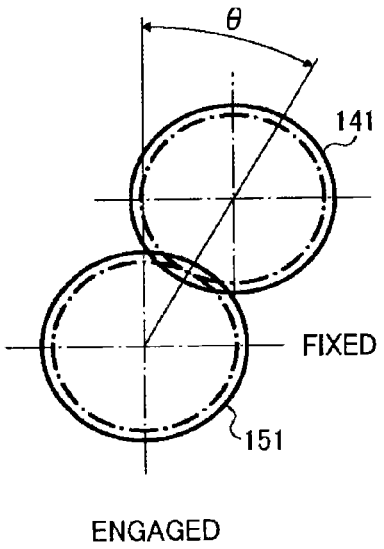
FIGS. 11A through 11D are schematic views of paired drive transmission gears to engage and disengage from each other according to an embodiment of this disclosure.
Figure 11B:
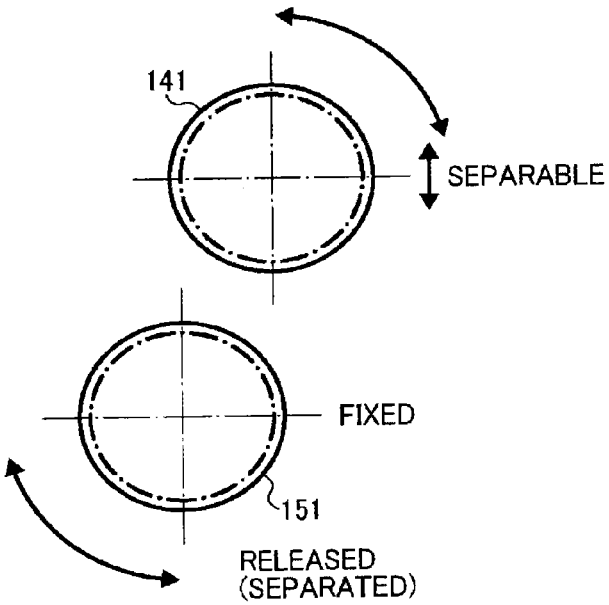
Figure 11C:
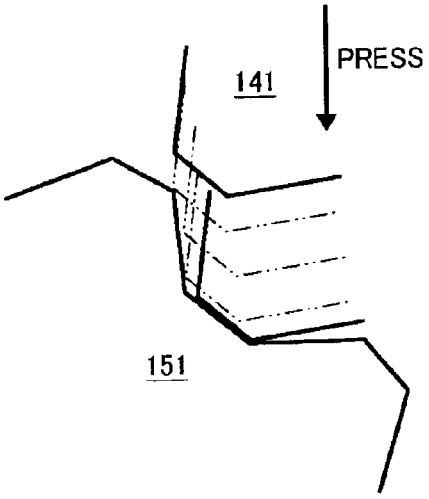
Figure 11D:
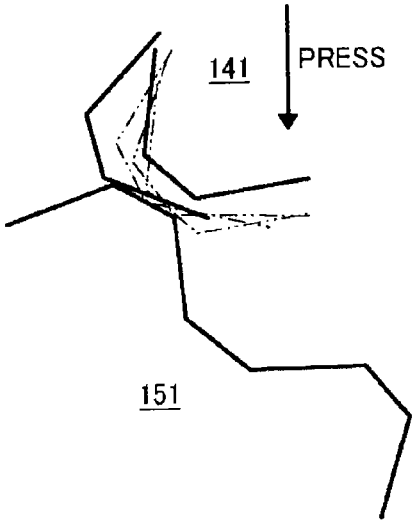

FIGS. 11A to 11D are views of an arrangement of the paired drive transmission gears 141 and 151 according to this embodiment of this disclosure. FIG. 11A is a view of the paired drive transmission gears 141 and 151 in engaged state. FIG. 11B is a view of the paired drive transmission gears 141 and 151 in disengaged (separated) state. FIG. 11C is an enlarged view of an engagement part of the paired drive transmission gears 141 and 151 when a tooth face of the second drive transmission gear 151 moves along a tooth face of the second drive transmission gear 151. FIG. 11D is an enlarged view of the first drive transmission gear 141 rotating in contact with an edge surface of the second drive transmission gear 151.

Figure 12A:
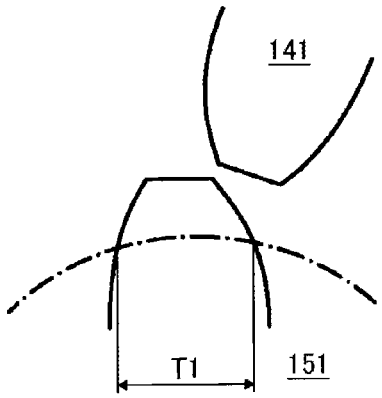
FIG. 12A is a schematic view of a chordal tooth thickness T1 of a second drive transmission gear according to an embodiment of this disclosure.
Figure 12B:
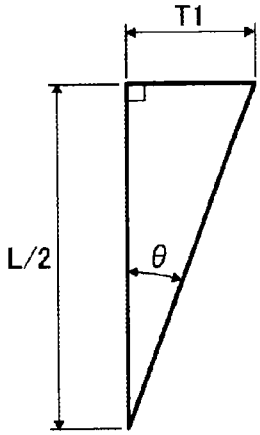
FIG. 12B is a schematic view of a lower limit value of an acute-side angle θ formed by a movement line and a line between axial centers.
Figure 12C:
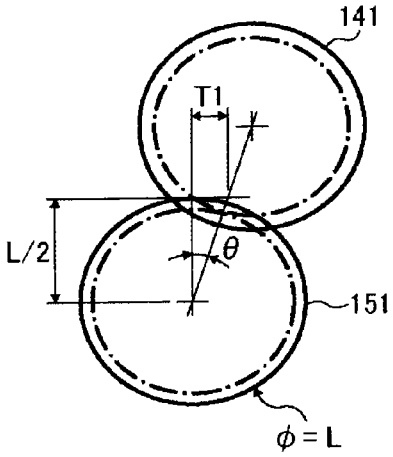
FIG. 12C is a schematic view of an engagement state of the paired drive transmission gears to which the relation shown in FIG. 12B is applied.

FIGS. 12A to 12C show a lower limit value of an acute-side angle θ formed by a movement line and a line between axial centers to obtain proper engagement. FIG. 12A shows a chordal tooth thickness T1 of the second drive transmission gear 151. FIG. 12B shows the lower limit value of the acute-side angle θ formed by the movement line and the line between axial centers with a circular radius L/2 of a front end of the second drive transmission gear 151 and the chordal tooth thickness T1. FIG. 12C shows an engagement state of the paired drive transmission gears 141 and 151 to which the relation shown in FIG. 12B is applied. In each of FIGS. 10A and 10B, 11A and 11B, and 12C, the tooth shape of each of the drive transmission gears 141C and 151C and 141 and 151 is omitted, a reference circle thereof is shown in broken line, and a front-end circle thereof is shown in solid line.

For the above-described sheet conveyor 30, the axial center of the rotation shaft of the first drive transmission gear 141 moves on a movement plane substantially perpendicular to a sheet conveyance direction, in response to contact or separation operation of contacting or separating the upper-side belt driving unit 31 relative to the lower-side belt driving unit 32. Such a configuration may have the following failure. For example, assume that, as illustrated in FIG. 10B, relative to the second drive transmission gear 151 connected in a fixed state to the driving source, the first drive transmission gear 141 driven for rotation is arranged so that a plane between the axial centers (interaxial-center plane) of the second drive transmission gear 151 and the first drive transmission gear 141 is identical to the movement plane, and the first drive transmission gear 141 is arranged to contact and separate from the second drive transmission gear 151. Here, FIG. 10A shows an engagement state of the first drive transmission gear 141 with the second drive transmission gear 151. FIG. 10B shows a state in which disengagement (separated) state of the first drive transmission gear 141 from the second drive transmission gear 151.

When the drive transmission gear 141 and the drive transmission gear 151 normally engage each other, as illustrated in FIG. 10C, an edge face of the first drive transmission gear 141 engages a tooth space of the second drive transmission gear 151 so as to fit in the tooth space. However, the first drive transmission gear 141 at the driven side is easily rotated in contact or separating operation because the rotation load is smaller than the second drive transmission gear 151. For example, as illustrated in FIG. 10D, the second drive transmission gear 151 may be rotated to a position at which edges faces of the first drive transmission gear 141 and the second drive transmission gear 151 oppose each other, thus causing engagement failure. In other words, after engagement is released (separated) to perform, e.g., sheet jam processing, jam processing is finished. When engagement is performed again, addendum faces of the respective drive transmission gears may oppose each other and cause conflict, thus preventing normal engagement. If such engagement failure occurs, an operator performing maintenance work manually rotates one of the drive transmission gears, thus reducing the operability.

Hence, the inventors have found that, in a sandwiched state, in other words, when the first drive transmission gear 141 is placed at the sandwiching position and the positional relation of the first drive transmission gear 141 to the second drive transmission gear 151 is in the following state, occurrence frequency of engagement failure can be reduced. The inventors have also found that good operability can be maintained without reducing the operability in replacement work of replacing any one of the conveyance belts.

First, the configuration having been found by the inventors to reduce the occurrence frequency of the engagement failure is described below. A movement plane on which the axial center of the rotation shaft of the first drive transmission gear 141 moves and an interaxial-center plane between the axial centers which is a plane including the axial centers of the rotation shafts of the first drive transmission gear 141 and the second drive transmission gear 151 are configured to have an angle within a predetermined range. The inventors have found that such a configuration can reduce the occurrence frequency of engagement failure. In other words, unlike the configuration illustrated in FIGS. 10A and 10B, as illustrated in FIGS. 11A and 11B, the movement plane and the interaxial-center plane form an angle θ within the predetermined range. As illustrated in FIGS. 11C and 11D, the respective drive transmission gears normally can engage each other. Specifically, as illustrated in FIG. 11C, a tooth face of the first drive transmission gear 141 is moved along a tooth face of the second drive transmission gear 151, thus allowing normal engagement. Alternatively, as illustrated in FIG. 11D, the first drive transmission gear 141 contacting an edge face of the second drive transmission gear 151 is rolled on the edge face to achieve normal engagement.

In addition, for the sheet conveyor 30 according to this embodiment, as illustrated in FIG. 6, the first drive transmission gear 141 and the second drive transmission gear 151 are configured to engage each other in the vicinity of the sheet conveyance face. Such a configuration further reduces the amount at which the upper-side belt driving unit 31 or the second drive transmission gear 151 protrudes from the conveyance face of a sheet S sandwiched and conveyed with the upper-side conveyance belt 56 and the lower-side conveyance belt 59 toward the other gear side, thus further suppressing a reduction in operability in maintenance work. The above-described configuration can be applied to a configuration in which the upper-side belt driving unit 31 is rotated around a rotation fulcrum, e.g., a first rotation fulcrum formed by the rotation shaft 171 or a second rotation fulcrum formed by the upper-side restriction protrusions 123. In such a case, the following effect can be obtained. That is, following the movement of the upper-side belt driving unit 31 between the sandwich position and the separation position, the first drive transmission gear 141 and the second drive transmission gear 151 can smoothly engage each other.

In addition, in this embodiment, as illustrated in, e.g., FIGS. 11C and 11D, the first drive transmission gear 141 and the second drive transmission gear 151 are cylindrical external-teeth spur gears. The axial centers of the rotation shafts of the first drive transmission gear 141 and the second drive transmission gear 151 are placed in parallel to each other in engagement state. Use of such spur gears allows a reduction in procurement cost or processing cost of the first drive transmission gear 141 and the second drive transmission gear 151, thus contributing to cost reduction of the sheet conveyor 30. However, embodiments of the present invention are not limited to the above-described configuration. For example, the first drive transmission gear 141 and the second drive transmission gear 151 may be cylindrical, external-teeth helical gears. The axial centers of the rotation shafts of the helical gears are placed in parallel to each other in engagement state. Use of such helical gears can reduce vibration and impact noise occurring when the first drive transmission gear 141 and the second drive transmission gear 151 engage each other.

Next, for the angle formed by the movement plane and the interaxial-center plane, a lower limit of the range of angles having been found by the inventors are described in detail.

Here, for example, a movement plane on which an axial center of a rotation shaft of a first gear may be configured to intersect with an interaxial-center plane which is a plane including the axial centers of the rotation shafts of the first gear and the second gear in sandwich state. For such intersection, a straight movement line which is a straight line on which a movement plane is projected from one end side of the rotation shaft of the second gear onto an imaginary projection plane perpendicular to the axial center of the second gear and a linear line between the axial centers which is a straight line on which the interaxial-center plane is projected form the same angle.

More specifically, when the second gear is projected from the one end side of the rotation shaft of the second gear onto the projection plane, the straight movement line and the straight line between the axial centers form the following acute-side angle of an angle degree of θ1. The straight movement line and the straight line between the axial centers form an angle such that the straight line between the axial centers passes a point away from a point at which a straight line parallel to the straight movement line passes the axial center of the rotation shaft of the second gear intersects with an edge circle of the second gear, by a distance of approximately half of the chordal tooth thickness T1 of the second gear in the sheet conveyance direction on a tangent of the edge circle of the second gear. In other words, where the diameter of the tooth edge circle of the second gear is represented by L (mm) and the chordal tooth thickness of the second gear is represented by T1, a relational expression represented by the following Formula 4 is satisfied: $\mathrm{Tan}^{-1}\theta 1 \approx (T1/2)/(L/2) = T1/L$ . . . Formula 4. However, for the above-described configuration, if the tooth edge surfaces of the first gear and the second gear contact each other, the rotation moment acting on each gear is small because the distance from the axial center of the rotation shaft of each gear to a line of action of a force (resultant force) that is parallel to the straight movement line and acts on each gear. Accordingly, when the tooth edge surfaces of the first gear and the second gear contact each other, neither the first gear nor the second gear rotates and engagement failure is likely to occur.

Hence, for the configuration of this embodiment, the movement plane on which the axial center of the rotation shaft of the first drive transmission gear 141 and the interaxial-center plane including the axial center of the rotation shaft of the second drive transmission gear 151 form an acute-side angle of θ° greater than the following angle. Here, where the diameter of the tooth edge circle of the second drive transmission gear 151 is represented by L (mm) and the chordal tooth thickness of the second drive transmission gear 151 is represented by T1 as illustrated in FIG. 12A, the acute-side angle θ° formed by the interaxial-center plane including the axial centers of the rotation shafts of the first drive transmission gear 141 and the second drive transmission gear 151 is set to be greater than a value of θ° obtained by a relational expression represented by the following Formula 5:

$$\mathrm{Tan}^{-1}\theta > T1/(L/2) = 2\times T1/L \qquad \text{Formula 5.}$$

T1/(L/2) of the above-described Formula 5 represents that a straight movement line which is a straight line on which a movement plane is projected from one end side of the rotation shaft of the second drive transmission gear 151 onto an imaginary projection plane perpendicular to the axial center of the second drive transmission gear 151 and the straight line between the axial centers which is a straight line on which the interaxial-center plane is projected have the following relation. As illustrated in FIGS. 12B and 12C, the acute-side angle of the straight line between the axial centers is θ° relative to a straight line parallel to a straight movement line passing the axial center of the rotation shaft of the second drive transmission gear 151 when the straight line between the axial centers passes the following point. The point is away at a distance corresponding to the chordal tooth thickness T1 on a tangent of the edge circle of the second drive transmission gear 151 from an intersection point at which the straight line parallel to the straight movement line passing the axial center of the rotation shaft of the second drive transmission gear 151 and the edge circle of the second drive transmission gear 151.

The relation of the following Formula 6 is obtained from the above-described Formula 5:

$$\mathrm{Tan}^{-1}(2\times T/L) < |\theta| \qquad \text{Formula 6.}$$

Accordingly, when the tooth edge surfaces of the respective gears contact each other as illustrated in FIG. 11D, the distance to the line of action of the force parallel to the straight movement line acting on each of the first drive transmission gear 141 and the second drive transmission gear 151 can be set to be longer than that of a conventional configuration. The rotation moment acting on each gear can be set to be greater than that of a conventional configuration, thus facilitating rotation of the first drive transmission gear 141 or the second drive transmission gear 151. Accordingly, the above-described configuration of this embodiment can reduce occurrence of engagement failure of the first drive transmission gear 141 and the second drive transmission gear 151 as compared with a configuration in which an acute-side angle θ1° is smaller than an angle obtained by $\mathrm{Tan}^{-1}(2\times T1/L)$.

In FIGS. 11A to 11D, as described above, the second drive transmission gear 151 connected to the driving motor 158 is in fixed state. However, rotation load to the second drive transmission gear 151 fluctuates in response to the engagement state of each gear and, e.g., each timing belt. Accordingly, a rotating one of the first drive transmission gear 141 and the second drive transmission gear 151 is switched depending on the rotation load to each of the first drive transmission gear 141 and the second drive transmission gear 151 and orientations of the edge surfaces of the first drive transmission gear 141 and the second drive transmission gear 151 contacting each other. It is to be noted that both the first drive transmission gear 141 and the second drive transmission gear 151 may be rotated.

Next, an upper limit of the range of angles formed by the movement plane and the interaxial-center plane, which has been found by the inventors is described below.

For a conventional configuration, as described above, a first gear is disposed between a longitudinal one end of a first driving roller and a rotation shaft that is substantially parallel to a sheet conveyance direction and is disposed at an outer position than the longitudinal one end of the first driving roller. However, in consideration of occurrence of engagement failure of the first gear and the second gear or maintenance work of such failure, it may be advantageous that the first gear and the second gear are disposed at an apparatus front-face side opposite a side at which the rotation shaft is disposed. It is to be noted that, for the configuration in which the first gear and the second gear are disposed at the apparatus front-face side, the first gear or the second gear might conflict with a jammed sheet removed in jam processing or a conveyance belt replaced in replacement work, thus reducing the operability.

Hence, the inventors define the upper limit of the range of angle θ° formed by the movement plane and the interaxial-center plane as represented by the following Formula 7:

$$|\theta|<45° \qquad \text{Formula 7.}$$

As represented by Formula 7, the absolute value of the angle θ° formed by the movement plane and the interaxial-center plane is set to be lower than 45°. Accordingly, the amount at which each gear protrudes from a conveyance face of a sheet S sandwiched and conveyed toward the other gear to be engaged, thus suppressing a reduction in the operability in maintenance work.

Thus, the following sheet conveyor can be provided by setting the acute-side angle formed by the interaxial-center plane and the movement plane so as to satisfy a range of the following Formula 1 obtained from the above-described Formula 6 and Formula 7:

$$\mathrm{Tan}^{-1}(2\times T1/L)<|\theta|<45° \qquad \text{Formula 1.}$$

The sheet conveyor has paired conveyance belts to sandwich and convey a sheet and two gears to engage each other in sandwich state in which the paired conveyance belts sandwich the sheet and disengage from each other in separation state in which the paired conveyance belts do not sandwich the sheet. The sheet conveyor can suppress occurrence of engagement failure of the gears when the gears shift from the separation state to the sandwich state. The sheet conveyor also has a configuration in which the paired conveyance belts are endlessly moved at the same speed with the drive transmission gears engaged to prevent side of the paired conveyance belts. Such a configuration can suppress occurrence of engagement failure of the drive transmission gears in closing operation in, for example, jam processing.

It is to be noted that the chordal tooth thickness T1 in the above-described Formula 1 may be directly measured or calculated using a known relational expression. However, embodiments of the present invention are not limited to the above-described configuration. For example, when the first drive transmission gear 141 and the second drive transmission gear 151 are standard gears of involute gears, arcuate tooth thickness T2 of the second drive transmission gear 151 may be employed as an approximate value of the chordal tooth thickness T1.

For example, where m represents module of the second drive transmission gear 151, π represents circular constant, T2 represents arcuate tooth thickness, the relation of the arcuate tooth thickness T2, the circular constant it, the module m, and the diameter of tooth edge circle L (mm) is obtained by the following Formula 2:

$$T2=\pi\times m/L \qquad \text{Formula 2.}$$

By using T2 of Formula 2 instead of T1 of Formula 1, the following Formula 3 can be obtained:

$$\mathrm{Tan}^{-1}(\pi\times m/L)<|\theta|<45° \qquad \text{Formula 3.}$$

By setting the acute-side angle θ° formed by the interaxial-center plane and the movement plane so as to satisfy the range represented by Formula 3, the following effects can be obtained. In a configuration in which Formula 3 is satisfied, when the second drive transmission gear 151 is projected on the above-described projection plane from one end side of the rotation shaft of the second drive transmission gear 151, the straight line between the axial centers passes the following point. That is, the point is a point away from the intersection point at which the straight line parallel to the straight movement line passing the axial center of the rotation shaft of the second drive transmission gear 151 intersects with the edge circle of the second drive transmission gear 151, at a distance corresponding to the arcuate tooth thickness of the second gear on a tangent on the edge circle of the second drive transmission gear 151. Since the arcuate tooth thickness T2 is greater than the chordal tooth thickness T1, the straight line between the axial centers passes a point farther away than the position of the lower limit represented by the above-described Formula 1.

Accordingly, the rotation moment acting on each gear can be set to be further greater than the position of the lower limit represented by the above-described Formula 1, thus allowing more reliable rotation of the gear. As a result, engagement failure of the first drive transmission gear 141 and the second drive transmission gear 151 can be suppressed.

Alternatively, in one embodiment, for example, a sheet conveyor 30 has a rotation shaft 171 forming a first rotation center parallel to a sheet conveyance direction and upper-side restriction protrusions 123 and lower-side restriction protrusions 133 at an apparatus rear-face side. Such a configuration can obtain the following effect. Even in the sheet conveyor 30 having a movement assembly of an upper-side belt driving unit 31 including a rotation unit 170, such as a hinge assembly, such a configuration allows smooth engagement of the first drive transmission gear 141 and the second drive transmission gear 151.

In the above-described embodiment, the sheet conveyor 30 includes two rotation centers substantially parallel to the sheet conveyance direction and a movement assembly to open and close the upper-side belt driving unit 31 while switching the two rotation centers. However, embodiments of the present invention are not limited to the above-described configuration. For example, a sheet conveyor may include a movement assembly having only the first rotation center. Alternatively, in one embodiment, a sheet conveyor includes an upper-side conveyance belt 56 of an upper-side belt driving unit 31 and a lower-side conveyance belt 59 of a lower-side belt driving unit 32 that are movable in parallel to each other.

In the above-described embodiment, the cooling device 9 includes the sheet conveyor 30 in which a sheet S having a raised temperature is sandwiched and conveyed with the paired conveyance belts including the upper-side conveyance belt 56 and the lower-side conveyance belt 59. Such a configuration allows the cooling device 9 to obtain effects equivalent to those of the above-described sheet conveyor 30. In this embodiment, the sheet conveyor 30 is disposed in the cooling device 9. However, embodiments of the present invention are not limited to such a configuration. For example, in one embodiment, such a sheet conveyor to sandwich and convey a sheet S is disposed within an apparatus body 100 of an image forming apparatus (e.g., a copier) 300. By employing the above-described sheet conveyor 30, the image forming apparatus 300 can obtain effects equivalent to those of the sheet conveyor 30.

In addition, by employing the above-described cooling device 9, the image forming apparatus 300 can obtain effects equivalent to those of the cooling device 9. In the above-description, the image forming apparatus 300 is a multifunctional device comparative with multiple color processing. For example, in at least one embodiment, an image forming apparatus is a monochromatic or other single-color specific image forming apparatus or multi-color (e.g., two-color) compatible image forming apparatus.

The above-descriptions relate to limited examples, and the present disclosure includes, e.g., the following aspects giving respective effects described below.

(Aspect A) A sheet conveyor, such as a sheet conveyor 30, includes a first driving roller, such as the upper-side stretching roller 55*a*, to rotate a first conveyance belt, such as the upper-side conveyance belt 56, a second driving roller, such as the lower-side stretching roller 57*a*, to rotate a second conveyance belt, such as the lower-side conveyance belt 59, a first gear, such as the first drive transmission gear 141, to transmit a rotation driving force to the first driving roller, and a second gear, such as the second drive transmission gear 151, to engage the first gear and transmit to the first gear a rotation driving force of a driving source, such as the driving source 158, for rotating the second driving roller. The first gear and the second gear engage each other in a sandwich state in which the first conveyance belt and the second conveyance belt can sandwich and convey the sheet. In a separation state in which the first conveyance belt and the second conveyance belt are separated from each other, engagement of the first conveyance belt and the second conveyance belt is released. When the sandwich state and the separation state are switched, an axial center of a rotation shaft of the first gear or the second gear moves on a movement plane substantially perpendicular to a direction in which the sheet is sandwiched and conveyed. In the sheet conveyor, where L (mm) represents the diameter of a tooth edge circle of the second gear and T1 represents a chordal tooth thickness of the second gear, an acute-side angle θ° formed by the movement plane and an interaxial-center plane including the axial center of the rotation shaft of the first gear and the axial center of the rotation shaft of the second gear in the sandwich state is within a range represented by the following Formula 1:

$$\mathrm{Tan}^{-1}(2\times T1/L)<|\theta|<45^\circ \qquad \text{Formula 1.}$$

Such a configuration gives the following effect as described in the above-described embodiments. Here, as described above, the movement plane on which the axial center of the rotation shaft of the first gear may intersect with the place between the axial centers which is a plane including the axial centers of the rotation shafts of the first gear and the second gear in sandwiched state. For such intersection, a straight movement line which is a straight line on which a movement plane is projected from one end side of the rotation shaft of the second gear onto a projection plane perpendicular to the axial center of the second gear and a linear line between the axial centers which is a straight line on which the interaxial-center plane is projected form the same angle.

Specifically, when the second gear is projected from the one end side of the rotation shaft of the second gear onto the projection plane, the straight movement line and the straight line between the axial centers form the following angle. The straight movement line and the straight line between the axial centers form an angle θ1° such that the straight line between the axial centers passes a point away from a point at which a straight line parallel to the straight movement line passes the axial center of the rotation shaft of the second gear intersects with an edge circle of the second gear, by a distance of approximately half of the chordal tooth thickness T1 of the second gear in the sheet conveyance direction on a tangent of the edge circle of the second gear. However, for the above-described configuration, if the tooth edge surfaces of the first gear and the second gear contact each other, the rotation moment acting on each gear is small because the distance from the axial center of the rotation shaft of each gear to a line of action of a force (resultant force) that is parallel to the straight movement line and acts on each gear. Accordingly, when the tooth edge surfaces of the first gear and the second gear contact each other, neither the first gear nor the second gear rotates and engagement failure is likely to occur.

By contrast, in the configuration of Aspect A, the absolute value of the acute-side angle is greater than $\mathrm{Tan}^{-1}(2\times T1/L)$ which is greater than θ1. Accordingly, when the second gear is projected from one end side of the rotation shaft of the second gear onto the projection plane, the straight line between the axial centers passes the following point. The point is a point away from a point at which a straight line parallel to the straight movement line passes the axial center of the rotation shaft of the second gear intersects with an edge circle of the second gear, by a distance not smaller than the chordal tooth thickness T1 of the second gear in the sheet conveyance direction on a tangent of an edge circle of the second gear. Accordingly, when the tooth edge surfaces of the respective gears contact each other, the distance to a line of action of the force parallel to the straight movement line acting on each of the first gear and the second gear can be set to be longer than that of a conventional configuration. The rotation moment acting on each gear can be set to be greater than that of a conventional configuration, thus facilitating rotation of the first drive transmission gear 141 or the second drive transmission gear 151. Accordingly, the configuration of Aspect A can reduce occurrence of engagement failure of the first gear and the second gear as compared with a configuration in which an acute-side angle θ° is smaller than an angle obtained by $\mathrm{Tan}^{-1}(2\times T1/L)$.

Furthermore, since the acute-side angle θ° is smaller than 45°, the amount at which each gear protrudes from a conveyance face of a sheet sandwiched and conveyed toward the other gear to be engaged, thus suppressing a reduction in the operability in maintenance work. Accordingly, the following sheet conveyor can be provided. The sheet conveyor has paired conveyance belts to sandwich and convey a sheet and two gears to engage each other in sandwich state in which the paired conveyance belts sandwich the sheet and disengage from each other in separation state in which the paired conveyance belts do not sandwich the sheet. The sheet conveyor can suppress occurrence of engagement failure of the gears when the gears shift from the separation state to the sandwich state.

(Aspect B) In Aspect A, the first gear, such as the first drive transmission gear 141, and the second gear, such as the second drive transmission gear 151, are standard gears of involute gears. Where m represents module of the second gear, π represents circular constant, and T2 represents arcuate tooth thickness of the second gear, when the relation of the arcuate tooth thickness T2, the circular constant π, the module m, and the diameter of tooth edge circle L (mm) is obtained by the following Formula 2:

$$T2=\pi\times m/L \qquad \text{Formula 2,}$$

and the acute-side angle θ° is within a range represented by the following Formula 3:

$$\mathrm{Tan}^{-1}(\pi\times m/L)<|\theta|<45^\circ \qquad \text{Formula 3.}$$

Such a configuration gives the following effect as described in the above-described embodiments. In the configuration of Aspect B, when the second gear is projected from one end side of the rotation shaft of the second gear onto the projection plane, the straight line between the axial centers passes the following point. The point is a point away from a point at which a straight line parallel to the straight movement line passes the axial center of the rotation shaft of the second gear intersects with an edge circle of the second gear, by a distance not smaller than an arcuate tooth thickness T2 of the second gear in the sheet conveyance direction on a tangent of an edge circle of the second gear. Since the arcuate tooth thickness T2 is greater than the chordal tooth thickness T1, the interaxial straight line passes a point farther away than the position of the lower limit in the above-described Aspect A, in a tangent direction of a tooth edge circle of the second gear from the point at which the straight line parallel to the straight movement line passes the axial center of the rotation shaft of the second gear intersects with a tooth edge circle of the second gear. Accordingly, the rotation moment acting on each gear can be set to be further greater than in Aspect A, thus allowing more reliable rotation of the gear. As a result, engagement failure of the second gear can be suppressed.

(Aspect C) In Aspect A or Aspect B, the sheet conveyor further includes a first belt driving unit, such as the upper-side belt driving unit 31, to hold the first driving roller, such as the upper-side stretching roller 55*a*, a second belt driving unit, such as the lower-side belt driving unit 32, to hold the second driving roller, such as the lower-side stretching roller 57*a*, and a movement assembly, such as the movement assembly 190, to move the first belt driving unit to a sandwich position at which the first conveyance belt and the second conveyance belt are in the sandwich state and a separation position at which the first conveyance belt and the second conveyance belt are in the separation state. The movement assembly is disposed at a first end side of the first belt driving unit and the second belt driving unit in a rotation axis direction of the second driving roller and includes a rotation unit, such as the rotation unit 170, to hold the first belt driving unit relative to the second belt driving unit so as to be rotatable around a rotation shaft, such as the rotation shaft 171, substantially parallel to the direction in which the first conveyance belt and the second conveyance belt convey the sheet. The first gear, such as the first drive transmission gear 141, and the second gear, such as the second drive transmission gear 151, are disposed at one end of the first driving roller and the second driving roller, respectively, in the sandwich position to engage each other at a second end side of the first belt driving unit and the second belt driving unit opposite the first end side at which the rotation unit is disposed. For such a configuration, as described in the above-described embodiments, when the sheet conveyor, such as the sheet conveyor 30, has a movement assembly of a first belt driving unit including a rotation unit, e.g., a hinge assembly, such a configuration allows smooth engagement of the first gear and the second gear.

(Aspect D) In any of Aspects A through C, the first gear, such as the first drive transmission gear 141, and the second gear, such as the second drive transmission gear 151, engage each other in the vicinity of the conveyance face of the sheet, such as a sheet S, sandwiched and conveyed with the first conveyance belt, such as the upper-side conveyance belt 56, and the second conveyance belt, such as the lower-side conveyance belt 59. Such a configuration gives the following effect as described in the above-described embodiments. Such a configuration further reduces the amount at which one of the first gear and the second gear protrudes from the conveyance face of a sheet S sandwiched and conveyed with the first conveyance belt and the second conveyance belt toward the other of the first gear and the second gear, thus further suppressing a reduction in operability in maintenance work.

(Aspect E) In any of Aspects A through D, the first gear, such as the first drive transmission gear 141, and the second gear, such as the second drive transmission gear 151 are spur gears. The axial center of the rotation shaft of the first gear and the axial center of the rotation shaft of the second gear are placed in parallel to each other when the first gear and the second gear engage each other. As described in the above-described embodiment, such a configuration allows a reduction in procurement cost or processing cost of the first gear and the second gear, thus contributing to cost reduction of the sheet conveyor, such as the sheet conveyor 30.

(Aspect F) In any of Aspects A through D, the first gear, such as the first drive transmission gear 141, and the second gear, such as the second drive transmission gear 151 are helical gears. The axial center of the rotation shaft of the first gear and the axial center of the rotation shaft of the second gear are placed in parallel to each other when the first gear and the second gear engage each other. As described in the above-described embodiment, such a configuration allows a reduction in vibration and impact noise when the first gear and the second gear engage each other.

(Aspect G) A cooling device, such as the cooling device 9, includes a sheet conveyor to sandwich and convey a sheet, such as a sheet S, having a raised temperature with paired conveyance belts including, e.g., the upper-side conveyance belt 56 and the lower-side conveyance belt 59, and a cooling member, such as the upper-side cooling member 33*a* and the lower-side cooling member 33*b*, to contact an inner circumferential surface of at least one of the paired conveyance belts and absorb heat of the sheet. As the sheet conveyor, the cooling device includes the sheet conveyor, such as the sheet conveyor 30, according to any one of Aspects A to F. As in the above-described embodiment, such a configuration can provide a cooling device capable of giving effects equivalent to those of the cooling device according to any one of the above-described aspect A through F.

(Aspect H) An image forming apparatus, such as the image forming apparatus 300 illustrated as a multifunctional peripheral, includes a sheet conveyor to sandwich and convey a sheet, such as a sheet S, with paired conveyance belts including, e.g., the upper-side conveyance belt 56 and the lower-side conveyance belt 59. As the sheet conveyor, the image forming apparatus includes the sheet conveyor, such as the sheet conveyor 30, according to any one of Aspects A through F. As in the above-described embodiments, such a configuration can provide an image forming apparatus capable of giving effects equivalent to the cooling device according to any one of the above-described aspect A through F.

(Aspect I) An image forming apparatus, such as the image forming apparatus 300 illustrated as a multifunctional peripheral, includes a cooling device to cool a sheet, such as a sheet S, having a raised temperature. As the cooling device, the image forming apparatus includes a cooling device, such as the cooling device 9, according to Aspect G. As in the above-described embodiment, such a configuration can provide an image forming apparatus capable of giving effects equivalent to those of the cooling device according to Aspect G.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet conveyor, comprising:

a first conveyance belt and a second conveyance belt to opposingly engage and convey a sheet;

a first driving roller to rotate the first conveyance belt;

a second driving roller to rotate the second conveyance belt;

a first gear to transmit a rotation driving force to the first driving roller; and a second gear to engage the first gear and transmit, to the first gear, a rotation driving force of a driving source for rotating the second driving roller, wherein the first gear and the second gear engage each other in an opposing engagement state in which the first conveyance belt and the second conveyance belt opposingly engage and convey the sheet, and disengage from each other in a separation state in which the first conveyance belt and the second conveyance belt are separated from each other, in switching between the opposing engagement state and the separation state, an axial center of a rotation shaft of the first gear or the second gear moves on a movement plane substantially perpendicular to a direction in which the first conveyance belt and the second conveyance belt convey the sheet, and where L represents diameter of a tooth edge circle of the second gear in unit of millimeter and T1 represents a chordal tooth thickness of the second gear, an acute-side angle θ in unit of degree (°) formed by the movement plane and an interaxial-center plane including the axial center of the rotation shaft of the first gear and the axial center of the rotation shaft of the second gear in the opposing engagement state is within a range represented by the following Formula 1:

$$\mathrm{Tan}^{-1}(2\times T1/L)<|\theta|<45°.$$

2. The sheet conveyor according to claim 1, wherein the first gear and the second gear are standard gears of involute gears, and where m represents module of the second gear, π represents circular constant, and T2 represents arcuate tooth thickness of the second gear, when a relation of the arcuate tooth thickness T2, the circular constant π, the module m, and the diameter L millimeters of the tooth edge circle of the second gear is obtained by the following Formula 2:

$$T2=\pi\times m/L, \text{ and}$$

the acute-side angle θ° is within a range represented by the following Formula 3:

$$\mathrm{Tan}^{-1}(\pi\times m/L)<|\theta|<45°.$$

3. The sheet conveyor according to claim 1, further comprising:

a first belt driving unit to hold the first driving roller;

a second belt driving unit to hold the second driving roller; and a movement assembly to move the first belt driving unit to an opposing engagement position at which the first conveyance belt and the second conveyance belt are in the opposing engagement state and a separation position at which the first conveyance belt and the second conveyance belt are in the separation state, wherein the movement assembly is disposed at a first end side of the first belt driving unit and the second belt driving unit in a rotation axis direction of the second driving roller and includes a rotation unit to hold the first belt driving unit relative to the second belt driving unit so as to be rotatable around a rotation shaft substantially parallel to the direction in which the first conveyance belt and the second conveyance belt convey the sheet, and wherein the first gear and the second gear are disposed at one end of the first driving roller and the second driving roller, respectively, to engage each other at a second end side of the first belt driving unit and the second belt driving unit opposite the first end side at which the rotation unit is disposed.

4. The sheet conveyor according to claim 1, wherein the first gear and the second gear engage each other in a vicinity of a conveyance face of the sheet opposingly engaged and conveyed with the first conveyance belt and the second conveyance belt.

5. The sheet conveyor according to claim 1, wherein the first gear and the second gear are spur gears, wherein the axial center of the rotation shaft of the first gear and the axial center of the rotation shaft of the second gear are placed in parallel to each other when the first gear and the second gear engage each other.

6. A cooling device, comprising:

the sheet conveyor according to claim 1 to opposingly engage and convey the sheet with the first conveyance belt and the second conveyance belt; and a cooler to contact an inner circumferential surface of at least one of the first conveyance belt and the second conveyance belt and absorb heat of the sheet.

7. An image forming apparatus, comprising the cooling device according to claim 6 to cool the sheet having a raised temperature.

8. An image forming apparatus, comprising the sheet conveyor according to claim 1 to opposingly engage and convey the sheet with paired conveyance belts including the first conveyance belt and the second conveyance belt.

9. A sheet conveyor, comprising:

a first conveyance belt and a second conveyance belt to opposingly engage and convey a sheet;

a first driving roller to rotate the first conveyance belt;

a second driving roller to rotate the second conveyance belt;

a first gear to transmit a rotation driving force to the first driving roller;

a second gear to engage the first gear and transmit, to the first gear, a rotation driving force of a driving source for rotating the second driving roller, and a movement assembly to move the first conveyance belt to engage the first gear and the second gear with each other in an opposing engagement state in which the first conveyance belt and the second conveyance belt are to opposingly engage and convey the sheet, and disengage the first gear and the second gear from each other in a separation state in which the first conveyance belt and the second conveyance belt are separated from each other, wherein in switching between the opposing engagement state and the separation state, an axial center of a rotation shaft of the first gear or the second gear moves on a movement plane crossing a direction in which the first conveyance belt and the second conveyance belt convey the sheet, and wherein the movement assembly is disposed at a first end side in a rotation axis direction of the second driving roller and includes a rotation unit to hold the first conveyance belt relative to the second conveyance belt so as to be rotatable around a rotation shaft, and wherein the first gear and the second gear are disposed at one end of the first driving roller and the second driving roller, respectively, to engage each other at a second end side of the first conveyance belt and the second conveyance belt opposite the first end side at which the rotation unit is disposed.

10. The sheet conveyor according to claim 9, wherein the driving source is disposed at the first end side at which the rotation unit is disposed.

11. The sheet conveyor according to claim 9, wherein the axial center of the rotation shaft of the second gear is disposed at a position downstream from the axial center of the rotation shaft of the first gear in the direction in which the first conveyance belt and the second conveyance belt convey the sheet.

12. The sheet conveyor according to claim 9, further comprising an engagement unit to maintain the opposing engagement state in which the first conveyance belt and the second conveyance belt are to opposingly engage and convey the sheet, wherein the engagement unit is disposed at same side as the first gear and the second gear.

13. A cooling device, comprising:

the sheet conveyor according to claim 9 to opposingly engage and convey the sheet with the first conveyance belt and the second conveyance belt; and a cooler to contact an inner circumferential surface of at least one of the first conveyance belt and the second conveyance belt and absorb heat of the sheet.

14. An image forming apparatus, comprising the cooling device according to claim 13 to cool the sheet having a raised temperature.

15. An image forming apparatus, comprising the sheet conveyor according to claim 9 to opposingly engage and convey the sheet with paired conveyance belts including the first conveyance belt and the second conveyance belt.

16. A sheet conveyor, comprising:

a first conveyance belt and a second conveyance belt to opposingly engage and convey a sheet;

a first driving roller to rotate the first conveyance belt;

a second driving roller to rotate the second conveyance belt;

a first gear to transmit a rotation driving force to the first driving roller; and a second gear to engage the first gear and transmit, to the first gear, a rotation driving force of a driving source for rotating the second driving roller, wherein the first gear and the second gear engage each other in an opposing engagement state in which the first conveyance belt and the second conveyance belt opposingly engage and convey the sheet, and disengage from each other in a separation state in which the first conveyance belt and the second conveyance belt are separated from each other, in switching between the opposing engagement state and the separation state, an axial center of a rotation shaft of the first gear or the second gear moves on a movement plane substantially perpendicular to a direction in which the first conveyance belt and the second conveyance belt convey the sheet, and where an interaxial-center plane including the axial center of the rotation shaft of the first gear and the axial center of the rotation shaft of the second gear in the opposing engagement state is angled with respect to the movement plane such that when addendum faces of the first gear and the second gear engage one another during switching from the separation state to the opposing engagement state, the addendum faces of the first gear and the second gear are mutually angled such that one of the first gear and the second gear is caused by the engagement to rotate to a position where the addendum faces of the first gear and the second gear do not engage one another.

17. A cooling device, comprising:

the sheet conveyor according to claim 16 to opposingly engage and convey the sheet with the first conveyance belt and the second conveyance belt; and a cooler to contact an inner circumferential surface of at least one of the first conveyance belt and the second conveyance belt and absorb heat of the sheet.

18. An image forming apparatus, comprising the sheet conveyor according to claim 16 to opposingly engage and convey the sheet with paired conveyance belts including the first conveyance belt and the second conveyance belt.

* * * * *